US010930420B2

(12) United States Patent
Hachiya et al.

(10) Patent No.: US 10,930,420 B2
(45) Date of Patent: Feb. 23, 2021

(54) COIL COMPONENT

(71) Applicant: TAIYO YUDEN CO., LTD., Tokyo (JP)

(72) Inventors: Masahiro Hachiya, Takasaki (JP); Hitoshi Matsuura, Takasaki (JP); Takayuki Arai, Takasaki (JP); Shuhei Kurahashi, Takasaki (JP); Hideo Machida, Takasaki (JP); Hidekazu Teshigawara, Takasaki (JP); Naoya Honmo, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 351 days.

(21) Appl. No.: 15/828,061

(22) Filed: Nov. 30, 2017

(65) Prior Publication Data

US 2018/0166199 A1 Jun. 14, 2018

(30) Foreign Application Priority Data

Dec. 9, 2016 (JP) ..... JP2016-239069

(51) Int. Cl.
*H01F 27/30* (2006.01)
*H01F 17/00* (2006.01)
(Continued)

(52) U.S. Cl.
CPC ..... *H01F 17/0033* (2013.01); *B22F 1/02* (2013.01); *H01F 1/20* (2013.01); *H01F 1/24* (2013.01);
(Continued)

(58) Field of Classification Search
CPC ..... H01F 17/0013; H01F 2027/2809; H01F 27/255; H01F 27/2804; H01F 41/04;
(Continued)

(56) References Cited

U.S. PATENT DOCUMENTS 5,349,743 A * 9/1994 Grader ..... H01F 17/0033 156/89.12
7,446,638 B2 * 11/2008 Nogi ..... H01F 3/14 336/200
(Continued)

FOREIGN PATENT DOCUMENTS

JP 2007027354 A 2/2007
JP 2013098210 A 5/2013
JP 2013110171 A 6/2013

*Primary Examiner* — Alexander Talpalatski
*Assistant Examiner* — Joselito S. Baisa
(74) *Attorney, Agent, or Firm* — Law Office of Katsuhiro Arai

(57) ABSTRACT

A coil component includes a magnetic body part and a coil part. The magnetic body part has first and second magnetic layers stacked together alternately in one axis direction, and cover parts covering the first and second magnetic layers from the one axis direction. The coil part has conductor patterns provided on the second magnetic layers. The magnetic body part includes: oblate soft magnetic grain-containing layers extending over the entire range of the magnetic body part in the direction perpendicular to the one axis direction, exposed in the direction perpendicular to the one axis direction, and formed by oblate soft magnetic grains whose thickness direction is oriented in the one axis direction; and spherical grain-containing layers adjoining the oblate soft magnetic grain-containing layers in the one axis direction, and formed by insulative spherical grains.

19 Claims, 17 Drawing Sheets

(51) Int. Cl.

| | |
|---|---|
| ***B22F 1/02*** | (2006.01) |
| ***H01F 27/255*** | (2006.01) |
| ***H01F 27/28*** | (2006.01) |
| ***H01F 1/20*** | (2006.01) |
| ***H01F 1/24*** | (2006.01) |
| ***H01F 1/36*** | (2006.01) |
| ***H01F 17/04*** | (2006.01) |
| ***H01F 27/29*** | (2006.01) |
| *H01F 41/02* | (2006.01) |
| *H01F 41/04* | (2006.01) |
| *H01F 1/147* | (2006.01) |
| *B22F 7/02* | (2006.01) |

(52) U.S. Cl.
CPC ..... *H01F 1/36* (2013.01); *H01F 17/0013* (2013.01); *H01F 17/04* (2013.01); *H01F 27/255* (2013.01); *H01F 27/2804* (2013.01); *H01F 27/292* (2013.01); *B22F 7/02* (2013.01); *B22F 2998/10* (2013.01); *B22F 2999/00* (2013.01); *H01F 1/14766* (2013.01); *H01F 41/0246* (2013.01); *H01F 41/04* (2013.01); *H01F 2017/0066* (2013.01); *H01F 2017/0093* (2013.01); *H01F 2017/048* (2013.01); *H01F 2027/2809* (2013.01)

(58) Field of Classification Search
CPC ..... H01F 17/0006; H01F 2017/0066; H01F 3/08; H01F 17/0033
USPC ..... 336/199
See application file for complete search history.

(56) References Cited

U.S. PATENT DOCUMENTS

| | | | | |
|---|---|---|---|---|
| 7,719,398 | B2 * | 5/2010 | Tsuzuki | H01F 17/0013 336/200 |
| 7,859,377 | B2 * | 12/2010 | Kawarai | H01F 17/0006 336/83 |
| 8,193,781 | B2 * | 6/2012 | Lin | H02K 35/02 322/3 |
| 8,525,630 | B2 * | 9/2013 | Kobayashi | H01F 17/0013 174/255 |
| 8,975,997 | B2 * | 3/2015 | Tonoyama | H01F 27/255 336/200 |
| 8,988,181 | B2 * | 3/2015 | Chang | H01F 17/0013 336/200 |
| 9,460,837 | B2 * | 10/2016 | Son | H01F 3/14 |
| 9,997,288 | B2 * | 6/2018 | Yamaguchi | H01F 17/0006 |
| 2009/0051476 | A1 * | 2/2009 | Tada | H01F 17/0013 336/105 |
| 2011/0006868 | A1 * | 1/2011 | Banno | H01F 17/0013 336/200 |
| 2012/0105188 | A1 * | 5/2012 | Lim | H01F 27/245 336/200 |

* cited by examiner

COIL COMPONENT

BACKGROUND

Field of the Invention

The present invention relates to a coil component having a magnetic body part formed by soft magnetic grains.

Description of the Related Art

It is widely known that the magnetic bodies of coil components used at high frequencies are ferrite cores. On the other hand, Patent Literatures 1 to 3 disclose coil components that are constituted by magnetic bodies constituted by soft magnetic alloy grains. These coil components achieve higher saturation characteristics than those using ferrite cores achieve.

Unlike ferrites, soft magnetic alloys have conductivity, so the coil components described in Patent Literatures 1 to 3 require constitutions that ensure insulation property of the magnetic body part. Patent Literature 1 uses a constitution whereby the soft magnetic alloy grains are coated with resin. Patent Literatures 2 and 3 use a constitution whereby oxide films are formed on the surfaces of soft magnetic alloy grains.

BACKGROUND ART LITERATURES

[Patent Literature 1] Japanese Patent Laid-open No. 2007-027354

[Patent Literature 2] Japanese Patent Laid-open No. 2013-098210

[Patent Literature 3] Japanese Patent Laid-open No. 2013-110171

SUMMARY

As electronic devices in which coil components are installed are designed for increasingly higher performance, there is also a need for coil components offering improved characteristics such as inductance. Effective ways to improve the inductance of a coil component while keeping it small include, for example, increasing the winding density of the coil and suppressing the leakage of magnetic flux.

To increase the winding density of the coil, the pitch of the coil must be shortened. However, shortening the pitch of the coil gives rise to a need to make the magnetic layers arranged between sections of the coil thinner. However, the thinner the magnetic layers arranged between sections of the coil become, the lower the magnetic permeability of the magnetic layers becomes.

Also, the thickness of the magnetic layers formed by soft magnetic grains is naturally limited by the sizes of soft magnetic grains. This means that, to make the magnetic layers even thinner, the sizes of soft magnetic grains must be reduced. However, reducing the sizes of soft magnetic grains causes the magnetic permeability of the magnetic layers to drop.

In the case of coil components, lower magnetic permeability of the magnetic layers arranged between sections of the coil makes it difficult to achieve higher inductance, even when the winding density of the coil is increased.

In light of the above situations, an object of the present invention is to provide a coil component offering high inductance.

Any discussion of problems and solutions involved in the related art has been included in this disclosure solely for the purposes of providing a context for the present invention, and should not be taken as an admission that any or all of the discussion were known at the time the invention was made.

To achieve the aforementioned object, the coil component pertaining to an embodiment of the present invention comprises a magnetic body part and a coil part.

The magnetic body part has first and second magnetic layers stacked together alternately in one axis direction, and cover parts covering the first and second magnetic layers from the one axis direction.

The coil part has conductor patterns provided on the second magnetic layers.

The magnetic body part includes: oblate soft magnetic grain-containing layers extending over the entire range of the magnetic body part in a direction perpendicular to the one axis direction, exposed in the direction perpendicular to the one axis direction, and formed by oblate soft magnetic grains whose thickness direction is oriented in the one axis direction; and spherical grain-containing layers adjoining the oblate soft magnetic grain-containing layers in the one axis direction, and formed by insulative spherical grains.

According to this constitution, the inductance of the coil component can be improved because the oblate soft magnetic grain-containing layers formed by the oblate soft magnetic grains are provided in the magnetic body part.

The first magnetic layers may consist of the oblate soft magnetic grain-containing layers.

According to this constitution, the magnetic permeability of the first magnetic layers improves in the direction perpendicular to the one axis direction. This way, the thickness of each of the first magnetic layers can be reduced while maintaining the magnetic permeability of the first magnetic layers. As a result, the inductance of the coil component can be improved by increasing the winding density of the coil part.

The first magnetic layers may have first spherical grains being the spherical grains which are arranged in the gaps between the oblate soft magnetic grains, and whose average size is smaller than the dimension of the oblate soft magnetic grains in the thickness direction.

The second magnetic layers may consist of the spherical grain-containing layers.

In the first magnetic layers, the quantity of the first spherical grains relative to the total quantity of the oblate soft magnetic grains and the first spherical grains may be 5 percent by volume or more but 15 percent by volume or less.

According to this constitution, the gaps between the oblate soft magnetic grains can be plugged by filling them with the spherical grains. Also, the magnetic permeability of the oblate soft magnetic grain-containing layers can be improved because of the spherical grains arranged in the gaps between the oblate soft magnetic grains.

The magnetic body part may further have the spherical grain-containing layers arranged between the first magnetic layers and the conductor patterns, and formed by second spherical grains being the spherical grains whose average size is smaller than the dimension of the oblate soft magnetic grains in the thickness direction.

According to this constitution, the gaps between the oblate soft magnetic grains can be blocked by covering grains with the spherical grain-containing layers formed by the second spherical grains.

The thickness of each of the first magnetic layers may be less than 10 μm.

According to this constitution, the thickness of each of the first magnetic layers can be reduced. As a result, the inductance of the coil component can be improved by increasing the winding density of the coil part.

The cover parts may have the oblate soft magnetic grain-containing layers and the spherical grain-containing layers.

According to this constitution, leakage of magnetic flux toward the outer side in the one axis direction can be suppressed with the oblate soft magnetic grain-containing layers provided in the cover parts. As a result, the inductance of the coil component improves.

Each of the cover parts may have each of first cover layers being one of the spherical grain-containing layers adjoining the outer side of one of the first or second magnetic layers in the one axis direction, and each of second cover layers being one of the oblate soft magnetic grain-containing layers adjoining the outer side of each of the first cover layers in the one axis direction.

According to this constitution, leakage of magnetic flux can be suppressed with the second cover layers, while ensuring the magnetic path with the first cover layers.

Each of the cover parts may further have each of third cover layers adjoining the outer side of each of the second cover layers in the one axis direction.

According to this constitution, the insulation property of the surface of each of the cover parts can be improved with each of the third cover layers constituted by spherical grains.

Each of the third cover layers may be formed by third spherical grains being spherical grains whose average size is smaller than the dimension of the oblate soft magnetic grains in the thickness direction.

According to this constitution, the insulation property of the surface of each of the cover parts can be improved with each of the third cover layers constituted by spherical grains.

The ratio of the longest dimension in the direction perpendicular to the thickness direction, to the dimension in the thickness direction, of the oblate soft magnetic grains, may be 4 or greater.

According to this constitution, the operation attributable to the oblate shape of the oblate soft magnetic grains can be achieved more effectively.

At least one type of the oblate soft magnetic grains and the spherical grains may be iron alloy grains containing iron, silicon, and at least one of chromium and aluminum.

According to this constitution, high saturation characteristics can be achieved in the iron alloy grains.

Oxide films may be formed on the surfaces of the iron alloy grains.

The iron alloy grains may be bonded to each other via the oxide films.

The thickness of the oxide films may be 0.6 μm or less.

According to these constitutions, the iron alloy grains are insulated by the oxide films. As a result, insulation property of the magnetic body part can be ensured.

The oxide films may have a multilayer structure that includes first oxide films and second oxide films formed on the outer side of the first oxide films.

The first oxide films may have, as the primary component, an oxide that contains at least one of chromium and aluminum.

The second oxide films may have, as the primary component, an oxide that contains iron and at least one of chromium and aluminum, and may be thicker than the first oxide films.

According to these constitutions, insulation property of the magnetic body part can be better ensured.

The magnetic body part may further have a resin covering the iron alloy grains.

According to this constitution, the iron alloy grains are insulated by the resin. As a result, insulation property of the magnetic body part can be ensured.

At least one type of the oblate soft magnetic grains and the spherical grains may be an amorphous alloy grains.

According to this constitution, the eddy current loss in the coil component can be reduced.

At least one type of the oblate soft magnetic grains and the spherical grains may be a ferrite grain.

According to this constitution, the oblate soft magnetic grains and the spherical grains can be obtained easily because ferrite, which can be easily flattened or made finer, is used.

The dimension of the coil component in the one axis direction may be 1 mm or less.

This coil component can be manufactured with high accuracy even when its dimension in the one axis direction is decreased in this way.

As described above, according to the present invention a coil component having high inductance can be provided.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
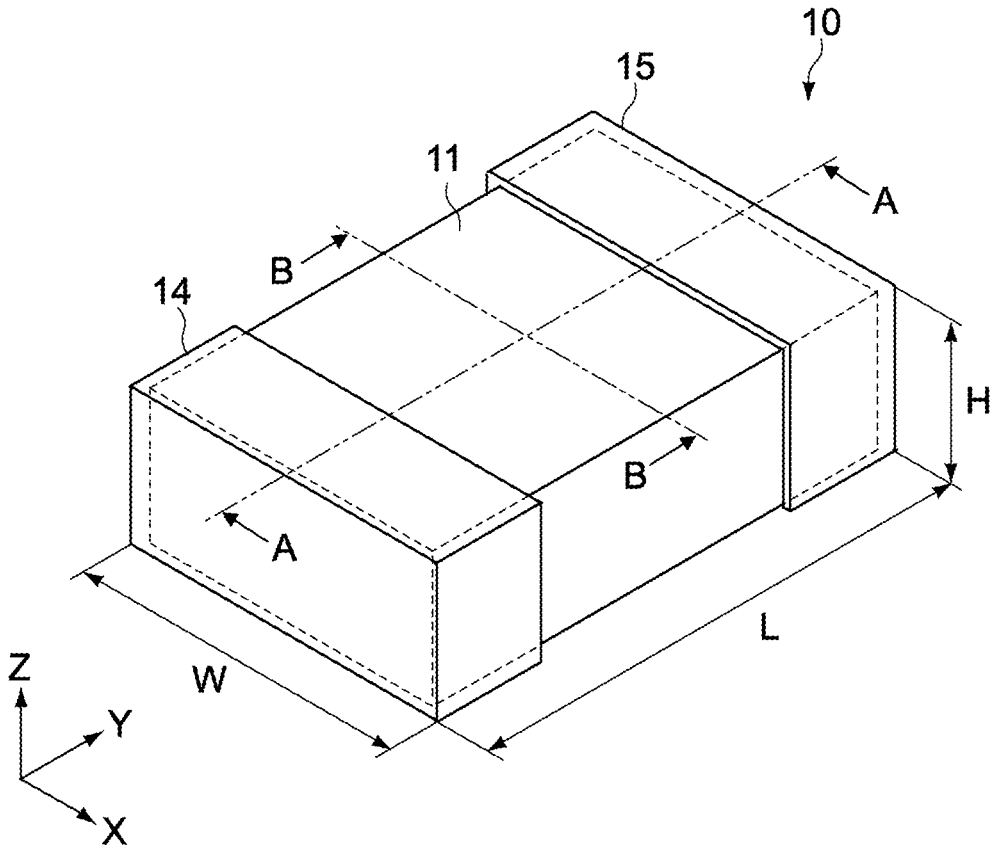
FIG. 1 is an oblique view of the coil component pertaining to the first embodiment of the present invention.

10—Coil component
11—Main body
12—Magnetic body part
12*a*—Cover parts
12*b*—First magnetic layers
12*c*—Second magnetic layers
13—Coil part
13*a*—Conductor patterns
13*b*—Via holes
14, 15—External electrode
G1, G2, G3—Soft magnetic grains

DETAILED DESCRIPTION OF EMBODIMENTS

Embodiments of the present invention are explained below by referring to the drawings. Shown in the drawings, as deemed appropriate, are an X-axis, a Y-axis, and a Z-axis that are perpendicular to one another. The X-axis, Y-axis, and Z-axis are the same in all drawings.

1. First Embodiment

1.1 Overall Constitution of Coil Component 10

Figure 2:
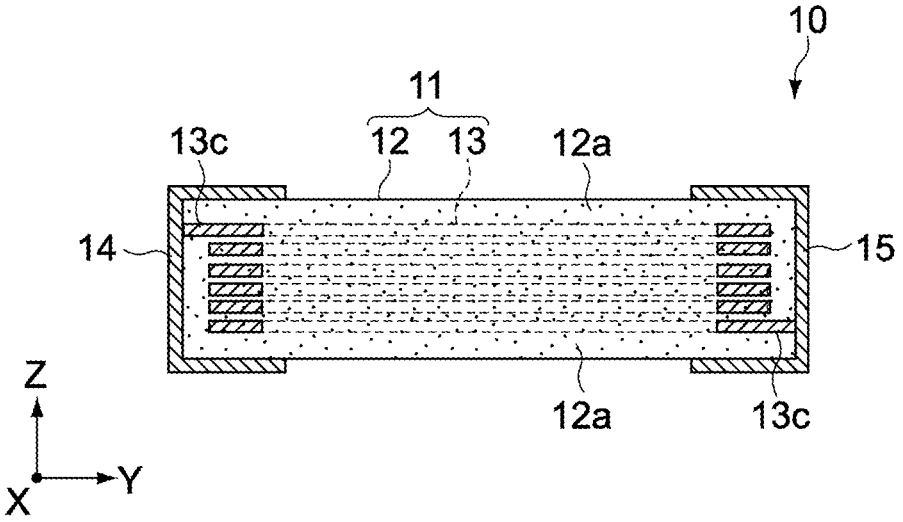
FIG. 2 is a cross-sectional view of the coil component along line A-A in FIG. 1.

FIGS. 1 and 2 are drawings showing a coil component 10 pertaining to the first embodiment of the present invention. FIG. 1 is an oblique view of the coil component 10. FIG. 2 is a cross-sectional view of the coil component 10 along line A-A in FIG. 1. The coil component 10 is constituted as a multilayer inductor having a layer structure. The coil component 10 has a main body 11, a first external electrode 14, and a second external electrode 15.

The coil component 10 is formed as a rectangular solid shape having a width W in the X-axis direction, a length L in the Y-axis direction, and a height H in the Z-axis direction. The width W, the length L, and the height H of the coil component 10 can be determined arbitrarily. For example, the length L, the width W, and the height H of the coil component 10 may be set as 1.6 to 2 mm, 0.8 to 1.2 mm, and 0.4 to 1.0 mm, respectively.

The external electrodes 14 and 15 cover both end faces of the main body 11 in the Y-axis direction and extend in the Y-axis direction along the four faces connecting both end faces. As a result, the external electrodes 14 and 15 have a U-shaped cross-section along the Y-axis direction. The external electrodes 14 and 15 are formed by conductive material and constitute a pair of terminals of the coil component 10.

It should be noted that the shape of the external electrodes 14 and 15 is not limited to the foregoing and can be changed as deemed appropriate according to the product specifications, etc. For example, the external electrodes 14 and 15 may extend only to one of the top face and the bottom face of the main body 11 in the Z-axis direction, and they may not extend to neither face of the main body 11 in the X-axis direction.

The main body 11 has a magnetic body part 12 and a coil part 13. The magnetic body part 12 forms the outline of the main body 11. The coil part 13 is arranged inside the magnetic body part 12. Cover parts 12*a* where the coil part 13 is not wound, are respectively provided at the top and the bottom of the magnetic body part 12 in the Z-axis direction.

It should be noted that the cover parts 12*a* need not be provided at both of the top and the bottom of the main body 11 in the Z-axis direction. In other words, a cover part 12*a* may be provided only at the top or the bottom of the main body 11 in the Z-axis direction. Also, the cover part 12*a* may have an additional constitution as necessary.

The coil part 13 is formed by conductive material and has a spiral shape whose center axis is parallel with the Z-axis. Provided at both ends of the spiral shape of the coil part 13 are lead ends 13*c* that are led out in the Y-axis direction. One of the lead ends 13*c* on the top side in the Z-axis direction is connected to the first external electrode 14, while the other of the lead ends 13*c* on the bottom side in the Z-axis direction is connected to the second external electrode 15.

The magnetic body part 12 is constituted as an aggregate of soft magnetic grains (soft magnetic powder), each formed by soft magnetic alloy having soft magnetic characteristics. To be specific, the soft magnetic grains are iron alloy grains whose primary component is a soft magnetic alloy that contains Fe (iron), Si (silicon), and further, at least one of Cr (chromium) and Al (aluminum).

To be more specific, preferably the soft magnetic grains contain Fe by 88 percent by weight or more. In this case, preferably the soft magnetic grains contain Si, Cr, and Al by 5 percent by weight or more in total. By using soft magnetic grains of such composition, the magnetic body part 12 having good saturation characteristics can be formed, while suppressing excessive oxidization.

Oxide films are formed on the surfaces of the soft magnetic grains constituting the magnetic body part 12. Preferably the thickness of each of the oxide films is 0.6 μm or less. Preferably the oxide films of the soft magnetic grains has a multilayer structure including first oxide films arranged on the inner side and second oxide films arranged on the outer side. In this case, preferably each of the second oxide films is thicker than each of the first oxide films.

Adjacent soft magnetic grains are bonded to each other via the oxide films. This way, the bonded soft magnetic grains are electrically insulated together, and thus the magnetic body part 12 achieves good insulation property. When the oxide films have a multilayer structure, preferably adjacent soft magnetic grains are bonded to each other in the outermost layer of the oxide films (such as the second oxide films mentioned above).

The oxide constituting the oxide films is not limited to any specific material. For example, the first oxide films may have an oxide containing at least one of Cr and Al (such as a Cr—O composition), as the primary component. Also, the second oxide films may have an oxide containing Fe and at least one of Cr and Al (such as a Fe—Cr—O composition), as the primary component.

With the coil component 10 pertaining to this embodiment, soft magnetic grains of different shapes may be used in the respective parts of the magnetic body part 12 to improve inductance. The details of the soft magnetic grains constituting the magnetic body part 12 are explained below in 1.2, "Constitution of Magnetic body part 12."

Figure 3:
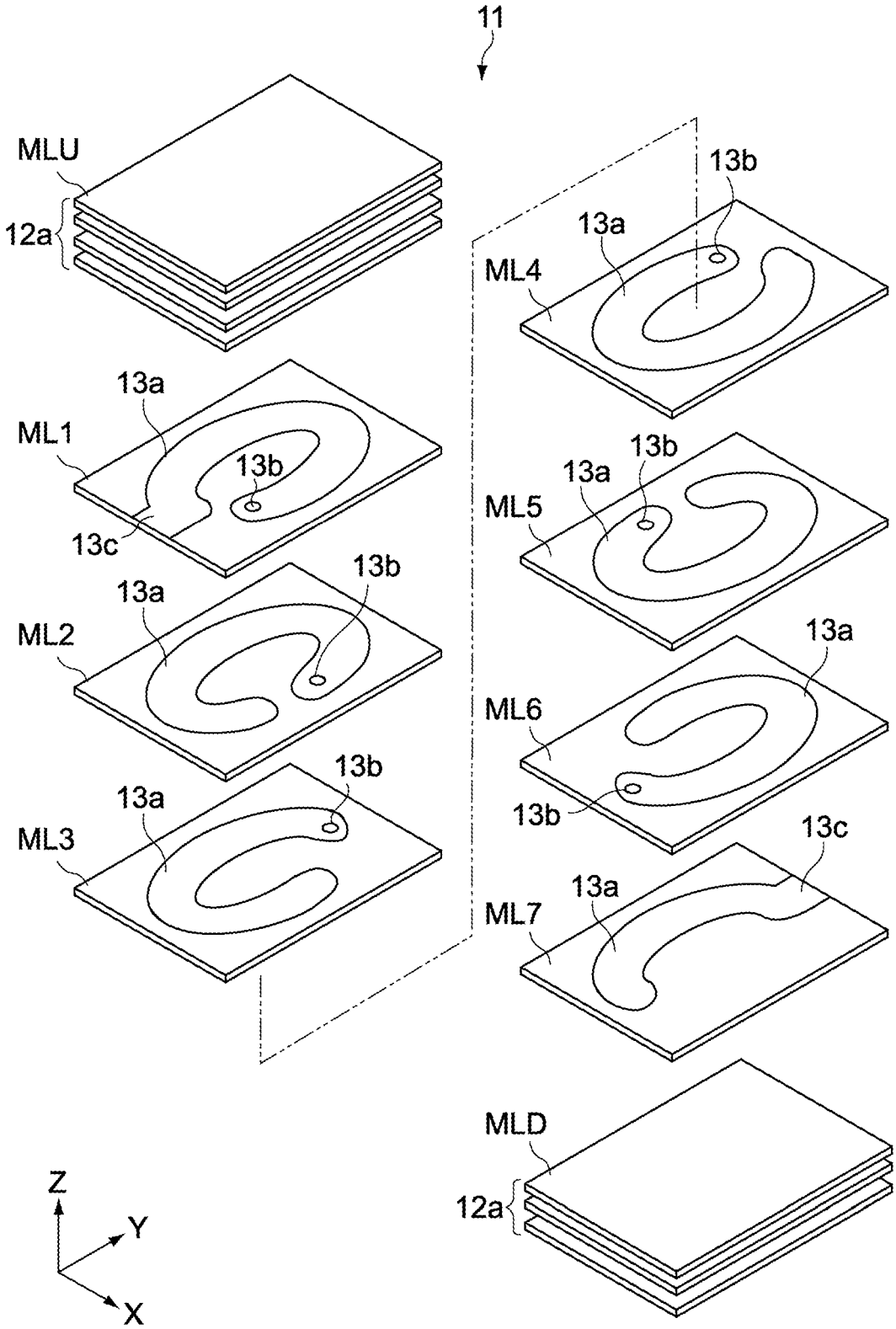
FIG. 3 is an exploded oblique view of the main body of the coil component.

FIG. 3 is an exploded oblique view of the main body 11. The main body 11 has layer parts ML* (i.e., MLU, ML1 to ML7, MLD) that are integrally stacked in the Z-axis direction. The topmost layer part MLU and the bottommost layer part MLD constitute the cover parts 12*a* of the magnetic body part 12. The coil part 13 is formed by the layer parts ML1 to ML7 sandwiched between the cover parts 12*a*.

The coil part 13 is constituted by conductor patterns 13*a* and via holes 13*b*. The respective conductor patterns 13*a* are formed in prescribed shapes along the top faces of the layer parts ML1 to ML7 in the Z-axis direction. Formed as part of the conductor patterns 13*a* of the topmost layer part ML1 and the bottommost layer part ML7 are the lead ends 13*c* for connecting the coil part 13 to the external electrodes 14 and 15.

The respective via holes 13*b* are formed in the layer parts ML1 to ML6 and constitute through conductors that penetrate the layer parts ML1 to ML6 in the Z-axis direction. As the conductor patterns 13*a* on the layer parts ML1 to ML7, which are adjacent in the Z-axis direction, are connected in series through the via holes 13*b*, the coil part 13 is formed which is spirally wound around its center axis oriented in the Z-axis direction.

It should be noted that the constitution of the coil part 13 is not limited to the foregoing. For example, the number of windings in the coil part 13 can be changed arbitrarily by changing the number of the layer parts ML being stacked. Also, the conductor patterns 13*a* need not have the shapes shown in FIG. 3. For example, the conductor patterns 13*a* may have rectangular shapes, polygonal shapes, or the like.

In addition, the constitution of the lead ends 13*c* is not limited to the foregoing. For example, the lead ends 13*c* may have the constitution shown in FIG. 4. According to this constitution, the lead ends 13*c* are led out from the coil part 13 in the Z-axis direction, not in the Y-axis direction, and are connected to the external electrodes 14 and 15 at the top face and bottom face of the main body 11 in the Z-axis direction.

Figure 4:
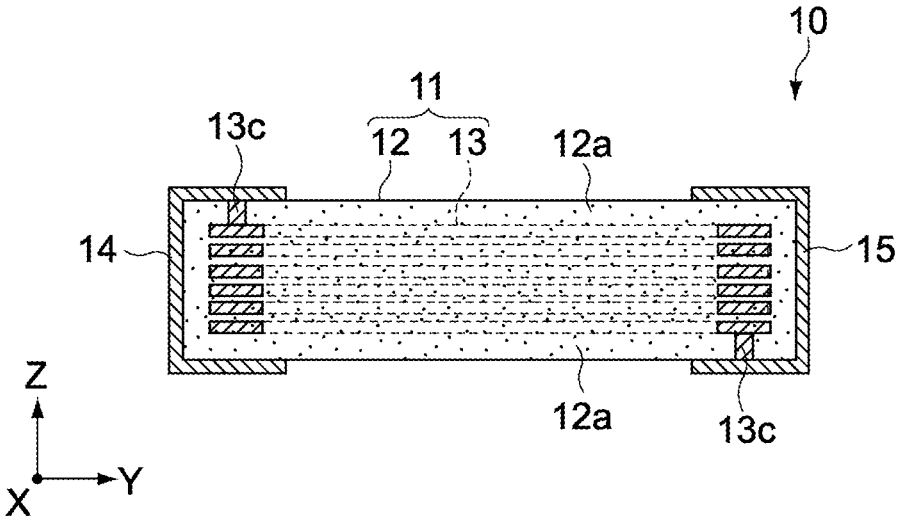
FIG. 4 is a cross-sectional view along line A-A in FIG. 1, showing a different mode of the coil component.

In other words, the lead ends 13*c* penetrate through the cover parts 12*a* in the Z-axis direction according to the constitution shown in FIG. 4. The lead ends 13*c* of such constitution can be formed by, for example, providing via holes, which are similar to the via holes 13*b* on the layer parts ML1 to ML8, on the layer parts MLU and MLD constituting the cover parts 12*a* shown in FIG. 3.

Furthermore, the layer structure in the main body 11 of the coil component 10 is not limited to the foregoing. For example, the number of the layer parts MLU and MLD used to constitute the respective cover parts 12*a* can be determined arbitrarily. In particular, each of the cover parts 12*a* may be constituted by the single layer part MLU or MLD that is formed according to the thickness of the cover parts 12*a*.

1.2 Constitution of Magnetic Body Part 12

Figure 5:
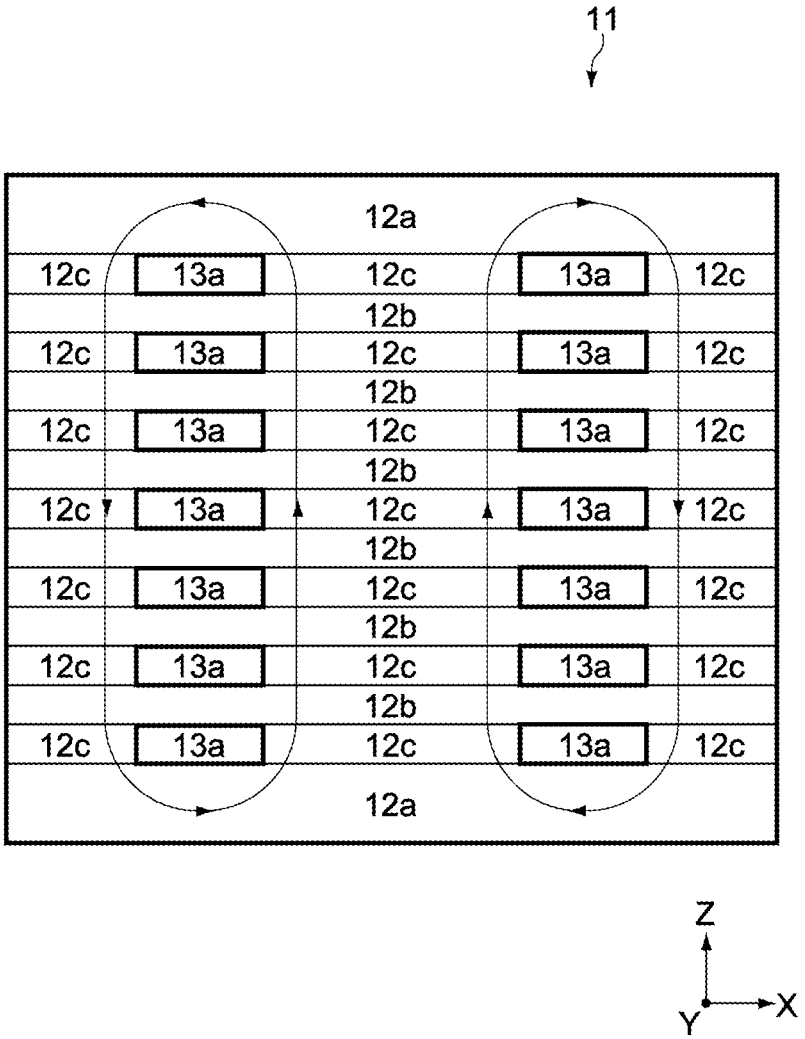
FIG. 5 is a schematic view showing a cross-sectional view of the coil component along line B-B of FIG. 1.

FIG. 5 is a schematic view showing a cross-section of the coil component 10 along line B-B in FIG. 1. In FIG. 5, the orientation of the magnetic flux generated by the coil part 13 is schematically shown using arrows. Needless to say, the orientation of the magnetic flux (orientation of the arrows) is reversed when electrical current flows through the coil part 13 in the opposite direction.

The magnetic body part 12 has first magnetic layers 12*b* and second magnetic layers 12*c*. The second magnetic layers 12*c* cover the surroundings of the conductor patterns 13*a* along an XY-plane and extend along the XY-plane together with the conductor patterns 13*a*. The first magnetic layers 12*b* are arranged between the conductor patterns 13*a* and the second magnetic layers 12*c*.

The first magnetic layers 12*b* extend over the entire range of the main body 11 along the XY plane and are exposed from the main body 11 in the X-axis direction and the Y-axis direction. This way, the coil component 10 can be manufactured at lower cost using simpler manufacturing processes compared to when the coil component 10 is constituted so that first magnetic layers are arranged only in some areas of a main body along the XY plane.

Also, according to the constitution where first magnetic layers are arranged only in some areas of a main body along the XY plane, height gaps tend to occur at the boundaries, and therefore ensuring accuracy becomes difficult when the dimension of the coil component in the Z-axis direction is set to 1 mm or less. In this regard, the coil component 10 pertaining to this embodiment can be manufactured with high accuracy even when its dimension in the Z-axis direction is set to 1 mm or less, or even when the dimension in the Z-axis direction is set to 0.8 mm or less.

Figure 6A:
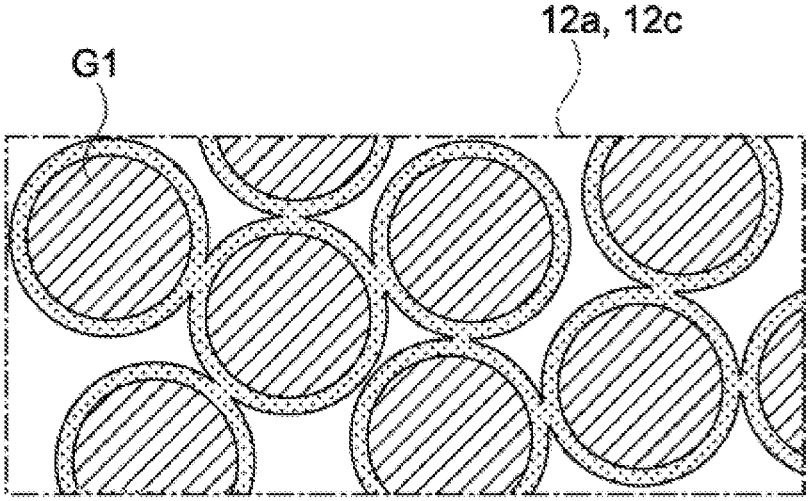
FIGS. 6A and 6B are schematic views showing a micro-structure of a cross-section of the magnetic body part of the coil component.

FIG. 6A is a schematic view showing a micro-structure of a cross-section of each of the cover parts 12*a* and the second magnetic layers 12*c*. Each of the cover parts 12*a* and the second magnetic layers 12*c* is constituted by spherical (including substantially spherical) soft magnetic grains G1. The adjacent soft magnetic grains G1 are bonded to each other via the oxide films on their surfaces. The average size of the soft magnetic grains G1 may be set to 2 to 30 μm, for example.

It should be noted that the average size of the soft magnetic grains G1 and other spherical grains may be set to the average of the sizes of those grains present over a randomly selected or prescribed area in a cross-section of the cover parts 12*a*, the first magnetic layers 12*b*, or the second magnetic layers 12*c* running in parallel with the Z-axis. Also, the average of the sizes of grains may be represented by a grain size that gives a cumulative grain size frequency of 50%, for example (e.g., D50—a cumulative 50% point of diameter).

Also, while the soft magnetic grains G1 shown in FIG. 6A have a uniform measure, the soft magnetic grains G1 may have a prescribed granularity distribution. Also, the average size of the soft magnetic grains G1 constituting each of the cover parts 12*a* may be different from that of the soft magnetic grains G1 constituting each of the second magnetic layers 12*c*.

The cover parts 12*a* must have high magnetic permeability to suppress leakage of magnetic flux toward the outer side in the Z-axis direction. From this viewpoint, preferably the soft magnetic grains G1 constituting each of the cover parts 12*a* are large. For example, the average size of the soft magnetic grains G1 constituting each of the cover parts 12*a* may be set to approx. 10 μm.

With the second magnetic layers 12*c*, on the other hand, preferably the soft magnetic grains G1 are large so as to ensure high magnetic permeability. However, preferably the soft magnetic grains G1 are small so as to ensure high dielectric strength voltage. For example, the average size of the soft magnetic grains G1 constituting each of the second magnetic layers 12*c* may be set to 2 μm or more but 6 μm or less.

Figure 6B:
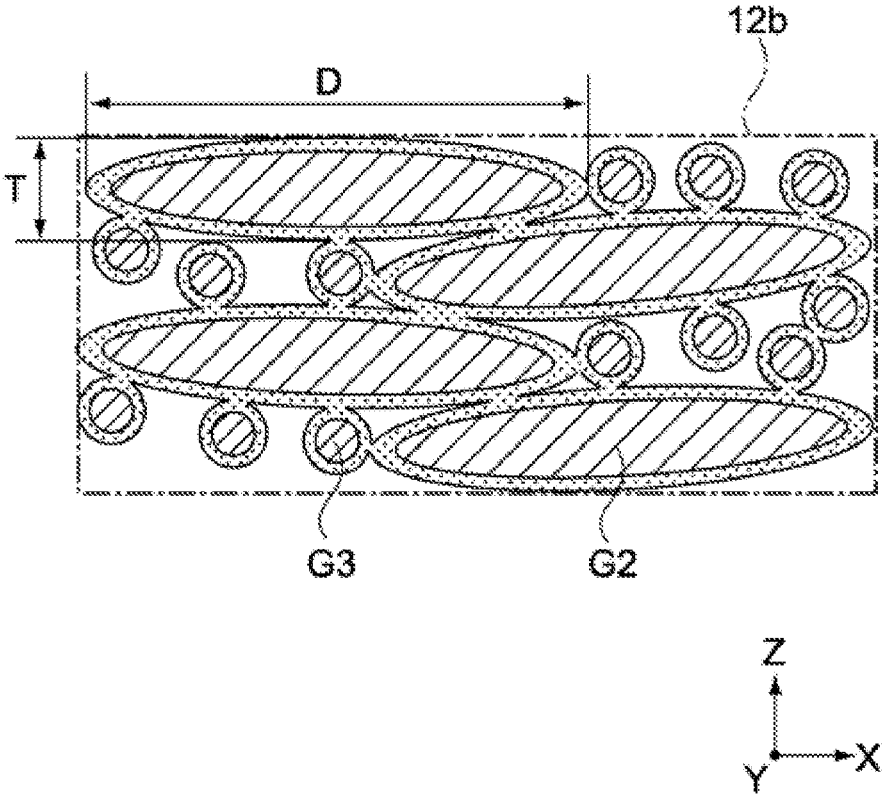

FIG. 6B is a schematic view showing a micro-structure of a cross-section of each of the first magnetic layers 12*b*. Each of the first magnetic layers 12*b* is constituted by soft magnetic grains G2 and G3. The soft magnetic grains G2 have an oblate shape (or flattened or depressed shape as viewed in the X/Y axis) (and typically a substantially spherical shape as viewed in the Z axis, wherein an aspect ratio is, e.g., approximately 4 to approximately 10), and their thickness direction is oriented in the Z-axis direction. The soft magnetic grains G3 are constituted as fine grains (fine powder) that are fine spherical grains whose average size is smaller than the average dimension of the soft magnetic grains G2 in the thickness direction.

Each of the first magnetic layers 12*b* is constituted as an oblate soft magnetic grain-containing layer where the oriented oblate soft magnetic grains G2 are arranged over its entire area. In addition, the fine soft magnetic grains G3 are arranged in a manner filling the gaps (voids or vacant spaces) between the soft magnetic grains G2. In some embodiments, the first magnetic layers 12*b* are constituted by a matrix formed by the oblate soft magnetic grains G2 bonded or connected together wherein gaps (voids or vacant spaces) between the oblate soft magnetic grains G2 are partially or substantially fully filled with the fine soft magnetic grains G3 which are not oblate and are substantially spherical and bonded or connected together and/or bonded or connected to the oblate soft magnetic grains G2. The adjacent soft magnetic grains G2 and G3 are bonded to each other via the oxide films on their surfaces. The "bonded" refers to joined securely to another, more than connected, typically via a single phase or same phase of oxide films fused together (if an oxide film is simply contacted to another oxide film, the contact is not constituted by a single or same phase of oxide film, but is constituted by two oxide films having different phases. It should be noted that in alternative embodiments illustrated in FIGS. 13A and 13B described later, individual soft magnetic grains G1, G2, and G3 are not bonded via oxide film but are separated from each other by a resin and fixedly connected with each other via the resin, wherein the gaps between the individual soft magnetic grains are filled with the resin, thereby securing insulation between the grains. In the above alternative embodiments, the individual soft magnetic grains are not bonded to each other via oxide film, but each may be coated with oxide film. Other than the above difference, the structure formed by the grains in the alternative embodiments (FIGS. 13A and 13B) is generally or substantially similar to that in the embodiments illustrated in FIGS. 6A and 6B.

It should be noted that the thickness of the oblate-shaped soft magnetic grain G2 may be set, for example, to the average of the thickness of those grains present over a randomly selected or prescribed area in a cross-section of the cover parts 12*a*, the first magnetic layers 12*b*, etc., running in parallel with the Z-axis. Also, this average may be represented by a thickness that gives a cumulative thickness frequency of 50%, for example (e.g., D50—a cumulative 50% point of thickness).

Also, the average longest diameter of the oblate-shaped soft magnetic grains G2 may be set, for example, to the average of longest diameters of those grains present over a randomly selected or prescribed area in a cross-section running in parallel with the Z-axis, or cross-section running perpendicular to the Z-axis, of the cover parts 12*a*, the magnetic layers 12*b*, etc. Also, this average may be represented by a value that gives a cumulative longest-diameter frequency of 50%, for example (e.g., D50—a cumulative 50% point of longest diameter).

Figure 7:
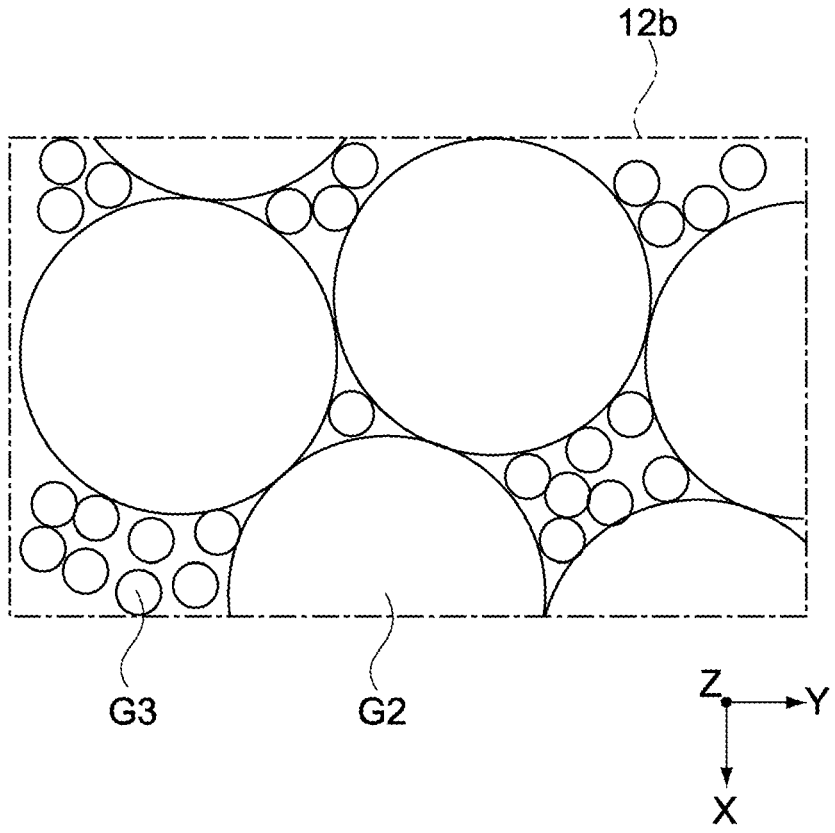
FIG. 7 is a schematic view showing a micro-structure of each of the first magnetic layers of the coil component.

FIG. 7 is a schematic view showing the positions of the soft magnetic grains G2 and G3 using their outlines, when the micro-structure of each of the first magnetic layers 12*b* is viewed from the Z-axis direction. In each of the first magnetic layers 12*b*, the fine soft magnetic grains G3 are filled in the gaps between the oblate soft magnetic grains G2. This means that, as the soft magnetic grains G3 function as plugs that at least partially plug the gaps between the soft magnetic grains G2, large gaps (voids or vacant spaces naturally or inherently formed without the soft magnetic grains G3) no longer exist in each of the first magnetic layers 12*b*.

Accordingly, each of the first magnetic layers 12*b* is configured such that, when the conductor patterns 13*a* are formed, conductor paste does not intrude easily into the gaps in each of the first magnetic layers 12*b*. As a result, shorting between the conductor patterns 13*a* in the Z-axis direction can be prevented. This, in turn, improves the manufacturing yield and reliability of the coil component 10.

Use of the thin, oblate soft magnetic grains G2 in the Z-axis direction makes it possible to form each of the first magnetic layers 12*b* thinly in the Z-axis direction. Also, the oblate soft magnetic grains G2 have anisotropic magnetic permeability, thereby exhibiting higher magnetic permeability in the direction along the XY-plane. Accordingly, the magnetic permeability of each of the first magnetic layers 12*b* is higher in the direction along the XY-plane.

This means that each of the first magnetic layers 12*b* can be made as thin as less than 10 μm in its thickness in the Z-axis direction, while ensuring magnetic permeability, by using the oblate soft magnetic grains G2. By making each of the first magnetic layers 12*b* thin, the number of the layer parts ML being stacked can be increased. This way, the inductance of the coil component 10 improves.

Also, with the first magnetic layers 12*b*, a magnetic property can also be added to the gaps between the soft magnetic grains G2 by arranging the soft magnetic grains G3 in the gaps between the soft magnetic grains G2. In particular, this compensates for the magnetic permeability of the first magnetic layers 12*b* in the Z-axis direction owing to the soft magnetic grains G3. As a result, the inductance of the coil component 10 improves further.

To be specific, it has been confirmed that combined use of the soft magnetic grains G2 and G3 for the first magnetic layers 12*b* achieves magnetic permeability equivalent to what is achieved when only spherical soft magnetic grains of 2 μm in average size are used, but with only half the thickness. As a result, the number of windings in the coil part 13 can be increased, and consequently the inductance of the coil component 10 can be improved significantly.

Also, in the first magnetic layers 12*b*, the soft magnetic grains G2 are not only directly bonded to each other, but the soft magnetic grains G2 are also bonded together via the soft magnetic grains G3 arranged in the gaps between the soft magnetic grains G2. This way, the bonding strength of the first magnetic layers 12*b* improves, and the reliability of the coil component 10 improves as a result.

Preferably the soft magnetic grains G2 have dimensions as uniform as possible in a major-axis direction perpendicular to the thickness direction, which means that, preferably their shapes approximate a circle when viewed from the thickness direction. For example, the thickness of the soft magnetic grains G2 may be set to approx. 1 μm, while the dimension of the soft magnetic grains G2 in the major-axis direction may be set to approx. 4 μm.

To achieve favorable operation from the oblate shape of the soft magnetic grains G2, preferably the aspect ratio of the soft magnetic grains G2 (ratio of an average longest diameter D to an average thickness T as shown in FIG. 6B) is 4 or greater. Also, to obtain the soft magnetic grains G2 in a uniform size, preferably the aspect ratio of the soft magnetic grains G2 is kept to 10 or smaller.

The soft magnetic grains G3 are sized to be able to fit in the gaps between the soft magnetic grains G2. To be specific, preferably the average size of the soft magnetic grains G3 is 1 μm or less.

It should be noted that, in FIGS. 6B and 7, the soft magnetic grains G2 and G3 respectively have a uniform shape. However, the soft magnetic grains G2 and G3 may respectively have a prescribed grain distribution, or the soft magnetic grains G2 and G3 may respectively have different shapes. Also, the thickness direction of the soft magnetic grains G2 may be slightly tilted with respect to the Z-axis direction.

Preferably, in each of the first magnetic layers 12*b*, the quantity of the soft magnetic grains G3 relative to the total quantity of the soft magnetic grains G2 and the soft magnetic grains G3 is 5 percent by volume or more but 15 percent by volume or less, such as 8 percent by volume. This way, the soft magnetic grains G3 tend to fill the gaps between the soft magnetic grains G2 in a favorable manner.

It should be noted that the volume of soft magnetic grains G1, G2, and G3 can be calculated using the averages of sizes of those grains present over prescribed areas in the respective cross-sections of each of the magnetic layers 12*b* and 12*c* running perpendicular to the X-axis, Y-axis, and Z-axis.

It should be noted that the constitution of the magnetic body part 12 is not limited to the foregoing and may be changed as deemed appropriate. For example, resin material may be filled in the gaps between the soft magnetic grains G1, G2, and G3 in the magnetic body part 12. Also, phosphate compounds may be deposited onto the surface of the soft magnetic grains G1, G2, and G3. These conditions improve the insulation property of the magnetic body part 12 further.

Also, the soft magnetic grains G1, G2, and G3 may be formed not by the same material, but by different materials. Furthermore, the soft magnetic grains G1, G2, and G3 are not limited to the constitution where they are formed by a soft magnetic alloy that contains Fe, Si, and at least one of Cr and Al; instead, they may be formed by other soft magnetic material.

For example, at least one of the soft magnetic grains G1, G2, and G3 may be amorphous alloy grains. This way, the eddy current loss in the coil component 10 can be reduced. Also, at least one of the soft magnetic grains G1, G2, and G3 may be ferrite grains that can be easily flattened or made finer.

Furthermore, although preferably the soft magnetic grains G3 are used for the first magnetic layers 12*b*, insulating fine grains having no magnetic property can also be used instead of the soft magnetic grains G3. The use of fine grains having no magnetic property is disadvantageous from the viewpoint of the magnetic permeability of the first magnetic layers 12*b* but can provide insulation property of the first magnetic layers 12*b* in a more reliable manner.

Additionally, the second magnetic layers 12*c* may have a structure identical to the structure of the first magnetic layers 12*b* shown in FIG. 6B, except that the structure is rotated by 90° with respect to the drawing. In this case, each of the second magnetic layers 12*c* has a structure where the oblate soft magnetic grains G2 stand along the Z-axis direction. This improves the magnetic permeability of the second magnetic layers 12*c* in the Z-axis direction along the orientation of magnetic flux.

1.3 Method for Manufacturing Coil Component 10

The following explains an example of how the coil component 10 is manufactured. FIGS. 8A to 8D are cross-sectional views showing the course of manufacturing the coil component 10 according to this manufacturing method. It should be noted that the method for manufacturing the coil component 10 is not limited to the constitution below; instead, it may be changed as deemed appropriate according to the constitution of the coil component 10, circumstances relating to equipment, and so on.

1.3.1 Magnetic Sheet Production Step

Figure 8A:
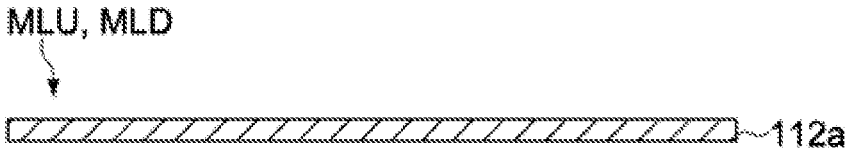
FIGS. 8A to 8D are cross-sectional views showing the course of manufacturing the coil component.
Figure 8B:
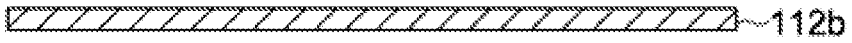
Figure 8C:
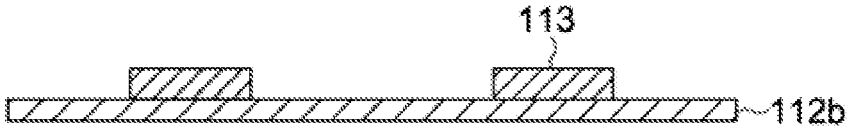

In the magnetic sheet production step, first magnetic sheets 112*a* shown in FIG. 8A and second magnetic sheets 112*b* shown in FIG. 8B are produced. The first magnetic sheets 112*a* represent unsintered layer parts MLU and MLD corresponding to the layer parts MLU and MLD shown in FIG. 3. The second magnetic sheets 112*b* correspond to the first magnetic layers 12*b* in the main body 11 shown in FIG. 5.

In order to form the first magnetic sheets 112*a*, a spherical-grained first metal magnetic powder having a composition of 5 percent by weight of Cr, 3 percent by weight of Si, and 92 percent by weight of Fe, and an average size of 10 μm, may be used, for example. The first metal magnetic powder becomes the material for the soft magnetic grains G1 shown in FIG. 6A. The first metal magnetic powder, binder (PVB, etc.), and solvent are mixed together to obtain a first magnetic paste.

The first magnetic paste is coated onto a base film and formed into a sheet shape. For the coating of the first magnetic paste onto the base film, a doctor blade, die-coater, or other coating machine may be used, for example. For the base film, a film formed by PET or other resin may be used, for example.

By drying the first magnetic paste coated on the base film, each of the first magnetic sheets 112*a* is obtained. For the drying of the first magnetic paste, a hot-air dryer or other dryer may be used, for example. The drying of the first magnetic paste using a dryer may be implemented under conditions of keeping a temperature of approx. 80° C. for approx. 5 minutes, for example.

Each of the first magnetic sheets 112*a* may be 100 μm thick, for example, corresponding to the thickness of each of the cover parts 12*a*. It should be noted that, as well as the layer parts MLU and MLD shown in FIG. 3, the multiple first magnetic sheets 112*a* may be stacked together to adjust each of the cover parts 12*a* to a prescribed thickness. In this case, the compositions and other constitutional elements of the respective first magnetic sheets 112*a* may be different.

In order to form the second magnetic sheets 112*b*, an oblate-grained second metal magnetic powder having a composition of 5 percent by weight of Cr, 3 percent by weight of Si, and 92 percent by weight of Fe, as well as a spherical-grained third metal magnetic powder of 0.5 μm in average size, may be used, for example. The second metal magnetic powder becomes the material for the soft magnetic grains G2 shown in FIG. 6B, while the third metal magnetic powder becomes the material for the soft magnetic grains G3 shown in FIG. 6B.

The oblate-grained second metal magnetic powder is obtained by flattening a spherical metal magnetic powder, for example. The flattening can be implemented by means of agitation in a ball mill under a condition of 240 hours, for example. It should be noted that the means for flattening is not limited to a ball mill, and the oblate-grained second metal magnetic powder may be obtained directly without implementing the flattening.

The second metal magnetic powder, third metal magnetic powder, binder (PVB, etc.) and solvent are mixed together to obtain a second magnetic paste. Preferably the quantity of the third metal magnetic powder relative to the total quantity of the second and third metal magnetic powders is 5 percent by volume or more but 15 percent by volume or less, such as 8 percent by volume.

Just like the first magnetic paste, the second magnetic paste is coated onto a base film and formed into a sheet shape. For the coating of the second magnetic paste onto the base film, a method that allows the oblate-grained second metal magnetic powder to be oriented in a favorable manner is used. Examples of such method include the doctor blade method, among others.

By drying the second magnetic paste coated on the base film, each of the second magnetic sheets 112*b* is obtained. For the drying of the second magnetic paste, a hot-air dryer or other dryer may be used, for example. The drying of the second magnetic paste using a dryer may be implemented under conditions of keeping a temperature of approx. 80° C. for approx. 5 minutes, for example.

The thickness of each of the second magnetic sheets 112*b* corresponds to the thickness of each of the first magnetic layers 12*b*, and may be set to less than 10 μm, for example. Also, the thickness of each of the second magnetic sheets 112*b* is approx. three to 10 times the average thickness of the grains of the second metal magnetic powder, or preferably approx. one-tenth the average longest diameter of the grains of the second metal magnetic powder. This way, the grains of the second metal magnetic powder can be oriented in a favorable manner.

1.3.2 Through Hole Forming Step

In the through hole forming step, through holes corresponding to the via holes 13*b* in the layer parts ML1 to ML6 shown in FIG. 3 are formed in the second magnetic sheets 112*b*. For the forming of through holes in the second magnetic sheets 112*b*, a stamping machine, laser processing machine, or other punching machine is used, for example. It should be noted that, to form the lead ends 13*c* shown in FIG. 4, the through hole forming step is also implemented for the first magnetic sheets 112*a*.

1.3.3 Conductor Paste Arrangement Step

In the conductor paste arrangement step, conductor paste 113 is printed onto the second magnetic sheets 112*b*, in patterns corresponding to the conductor patterns 13*a* on the layer parts ML1 to ML7 as shown in FIG. 3. As the conductor paste 113 is printed onto the layer parts ML1 to ML6, the conductor paste 113 fills the through holes formed in the through hole forming step.

For the conductor paste 113, an Ag paste may be used, for example. As an Ag paste, one with an Ag filling rate of 91 percent by weight or more may be used, for example. Also, for the conductor paste, a Cu paste, a Pt paste, an Au paste, etc., may also be used, for example, in addition to an Ag paste.

For the printing of the conductor paste 113 onto the second magnetic sheets 112*b*, a screen printer, gravure printer, or other printer may be used, for example.

Then, the conductor paste 113 thus arranged on the second magnetic sheets 112*b* is dried. For the drying of the conductor paste 113, a hot-air dryer or other dryer may be used, for example. The drying of the conductor paste 113 using a dryer may be implemented under conditions of keeping a temperature of approx. 80° C. for approx. 5 minutes, for example.

1.3.4 Third Magnetic Paste Arrangement Step

Figure 8D:
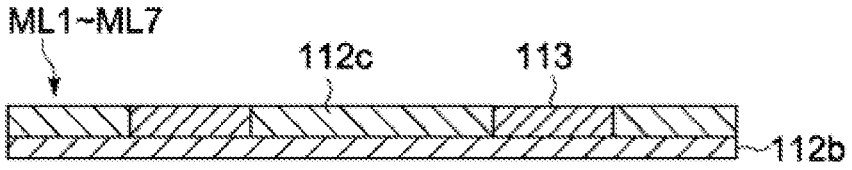

In the third magnetic paste arrangement step, a third magnetic paste 112*c* is printed onto the second magnetic sheets 112*b*, in patterns corresponding to the second magnetic layers 12*c* shown in FIG. 5, as shown in FIG. 8D. In other words, the third magnetic paste 112*c* is printed in patterns representing inverted patterns of the conductor paste 113.

For the third magnetic paste 112*c*, a spherical-grained fourth metal magnetic powder having a composition of 5 percent by weight of Cr, 3 percent by weight of Si, and 92 percent by weight of Fe may be used, for example. The fourth metal magnetic powder becomes the material for the soft magnetic grains G1 shown in FIG. 6A. The fourth metal magnetic powder, binder (PVB, etc.), and solvent are mixed together to obtain the third magnetic paste 112*c*.

Then, the third magnetic paste 112*c* thus arranged on the second magnetic sheets 112*b* is dried. For the drying of the third magnetic paste 112*c*, a hot-air dryer or other dryer may be used, for example. The drying of the third magnetic paste 112*c* using a dryer may be implemented under conditions of keeping a temperature of approx. 80° C. for approx. 5 minutes, for example.

Based on the above, unsintered layer parts ML1 to ML7 corresponding to the layer parts ML1 to ML7 shown in FIG. 3 are obtained. It should be noted that, for the printing of the third magnetic paste 112*c* onto the second magnetic sheets 112*b*, a screen printer, gravure printer, or other printer may be used, for example, as well as the printing of the conductor paste 113.

1.3.5 Stacking/Compression Step

In the stacking/compression step, the unsintered layer parts MLU, ML1 to ML7, and MLD are stacked and thermally compressed in the sequence shown in FIG. 3, to produce an unsintered main body 11. For the transfer of the layer parts MLU, ML1 to ML7, and MLD, a pickup transfer machine may be used. It should be noted that, for the thermal compression of the layer parts MLU, ML1 to ML7, and MLD, any of various types of press machines may be used.

1.3.6 Sintering Step

In the sintering step, the unsintered main body 11 obtained above is sintered in an atmosphere or other oxidizing ambience. For the sintering of the unsintered main body 11, a heat treatment machine such as any of various types of sintering ovens may be used. The sintering step includes a degreasing process and an oxide film-forming process explained below.

In the degreasing process, the binder, etc., present between metal magnetic powder grains is removed. As a result, pores (voids) are formed in the areas previously occupied by the binder, etc., between metal magnetic powder grains. At the same time, the binder, etc., are also removed from the conductor paste 113. The degreasing process can be implemented under conditions of keeping a temperature of approx. 300° C. for approx. 1 hour, for example.

The oxide film-forming process is implemented at a temperature higher than the temperature for the degreasing process, by raising the temperature following the degreasing process. In the oxide film-forming process, oxygen is supplied through the pores between metal magnetic powder grains, to oxidize the surface of metal magnetic powder grains. This way, oxide films of uneven shapes are formed on the surfaces of metal magnetic powder grains.

In other words, in the oxide film-forming process, the first metal magnetic powder grains become the soft magnetic grains G1 constituting the cover parts 12*a*, the second and third metal magnetic powder grains become the soft magnetic grains G2 and G3 constituting the first magnetic layers 12*b*, and the fourth metal magnetic powder grains become the soft magnetic grains G1 constituting the second magnetic layers 12*c*. This way, the magnetic body part 12 is formed.

Also, in the oxide film-forming process, the Ag grains that remain after the binder is removed from the conductor paste 113 in the degreasing process, are integrally sintered to form the coil part 13. The oxide film-forming process can be implemented under conditions of keeping a temperature of approx. 700° C. for approx. 2 hours, for example. This completes the main body 11.

It should be noted that, from the viewpoint of manufacturing efficiency, preferably the sintering step is implemented on a batch of multiple unsintered pieces of the main body 11 all at once. Also, the conditions for the sintering step can be changed from the above as deemed appropriate, and the step may include a process or processes other than the degreasing process and the oxide film-forming process. Also, each process included in the sintering step may be implemented separately.

1.3.7 Base Layer Forming Step

In the base layer forming step, base layers for the external electrodes 14 and 15 shown in FIGS. 1, 2 are formed on the main body 11 after a barrel polishing step. In the base layer forming step, a conductor paste is baked onto both ends of the main body 11 in the length direction where the external electrodes 14 and 15 are provided. The base layer forming step includes an application process and a baking process explained below.

In the application process, a conductor paste prepared beforehand is applied on both ends of the main body 11 in the length direction. For the application of the conductor paste, a dip-coater, a roller-coater, or any of various other types of known coaters may be used, for example. For the conductor paste, an Ag paste, a Cu paste, a Ni paste, a Pd paste, a Pt paste, an Au paste, an Al paste, etc., may be used, for example.

Any known Ag paste can be selected as deemed appropriate. As an Ag paste, for example, one containing 85 percent by weight or more of Ag, as well as glass, butyl carbitol (solvent), and polyvinyl butyral (binder) may be used. Also, the d50 (median size) of the Ag grains used for the Ag paste may be set to approx. 5 μm.

In the baking process, the conductor paste applied in the application process is baked onto the main body 11. For the baking process, a heat treatment machine such as any of various types of sintering ovens may be used, for example. The baking process can be implemented in atmosphere under conditions of keeping a temperature of approx. 600° C. for approx. 20 minutes, for example.

The baking process removes the solvent and binder from the base layers of the external electrodes 14 and 15, and also sinters the Ag grains. This completes the base layers of the external electrodes 14 and 15. It should be noted that the conditions for the baking process can be changed as deemed appropriate according to the type of conductor paste, etc.

1.3.8 Plating Step

In the plating step, which follows the base layer forming step, the baes layers formed on the main body 11 are plated. This way, a plating film is formed on the base layers and the external electrodes 14 and 15 are completed. The plating may be in the form of general electroplating using Ni (nickel), Sn (tin), etc. The plating film may have one layer or multiple layers.

The coil component 10 pertaining to this embodiment can be manufactured based on the above.

1.3.9 Other Steps

The method for manufacturing the coil component 10 may include steps other than the above, as necessary. Such other steps include (1) a barrel polishing step, (2) a phosphate treatment step, and (3) a resin-impregnation step, for example. These steps are explained below; however, steps that can be added are not limited to the following.

(1) Barrel Polishing Step

A barrel polishing step may be implemented on the main body 11 after the sintering step. In the barrel polishing step, barrel polishing is applied to the main body 11. The barrel polishing can be implemented by, for example, sealing multiple pieces of the main body 11 in a barrel container together with compound and water, and then agitating the barrel container. This way, corners and ridges of the main body 11 are chamfered in a favorable manner.

(2) Phosphate Treatment Step

In the course of manufacturing the coil component 10, exposed parts where the conductive alloy component is exposed may be formed on the soft magnetic grains G1, G2, and G3 constituting the magnetic body part 12 due to breakage of the oxide films. Such exposed parts are formed where insufficient oxygen has been supplied in the sintering step or where the oxide films have separated due to barreling, etc.

Presence of the conductive exposed parts on the soft magnetic grains G1, G2, and G3 constituting the magnetic body part 12 causes the insulation property of the magnetic body part 12 to drop. As the insulation property of the magnetic body part 12 drops, the electrostatic withstand voltage of the coil component 10 drops, and consequently the coil component 10 becomes vulnerable to damage caused by static electricity.

Also, when the insulation property of the surface of the magnetic body part 12 drops, the plating film may extend beyond the base layers and reach the surface of the magnetic body part 12 during the plating step. Such plating extension causes the dielectric strength between the external electrodes 14 and 15 to drop, resulting in lower reliability of the coil component 10.

To prevent these problems, a phosphate treatment step may be implemented on the main body 11 after the base layer forming step. In the phosphate treatment step, the main body 11 on which the base layers have been formed is treated with phosphate by soaking it in a phosphate treatment solution. The phosphate treatment solution is produced from phosphate salts and contains phosphate ions and metal ions.

The phosphate treatment causes phosphate ions in the phosphate treatment solution to selectively react with Fe which is present in abundance in the conductive exposed parts of the soft magnetic grains G1, G2, and G3. This causes phosphate compounds having insulation property to deposit on the exposed parts. This means that the exposed parts are covered by the insulating phosphate compounds.

Accordingly, by treating the main body 11 with phosphate for an appropriate period, phosphate compounds completely cover the exposed parts of the soft magnetic grains G1, G2, and G3, thus eliminating all conductive areas from the surface of the magnetic body part 12. This ensures high insulation property of the magnetic body part 12.

Also, the phosphate treatment causes the phosphate treatment solution to penetrate into the magnetic body part 12 through the pores (voids) between the soft magnetic grains G1, G2, and G3, so the exposed parts of the soft magnetic grains G1, G2, and G3 inside the magnetic body part 12 are also covered by the phosphate compounds. This ensures insulation property of the interior of the magnetic body part 12.

For the phosphate salt used in the phosphate treatment solution, preferably manganese phosphate is used. It should be noted, however, that the phosphate salt used in the phosphate treatment solution is not limited to manganese phosphate, and iron phosphate, calcium phosphate, zinc phosphate, etc., may also be used, for example.

(3) Resin-Impregnation Step

A resin-impregnation step may be implemented on the main body 11 after the base layer forming step, for example. If the aforementioned phosphate treatment step is implemented, the resin-impregnation step may be implemented either before or after the phosphate treatment step. In the resin-impregnation step, resin material is filled in the pores between the soft magnetic grains G1, G2, and G3.

The resin-impregnation step includes a soaking process, a wiping process, and a drying process explained below. In the soaking process, the main body 11 is soaked in a solution containing resin material to cause the solution containing resin material to penetrate into the pores in the magnetic body part 12. For the resin material, silicon resin may be used, for example.

The resin material is not limited to silicon resin, and epoxy resin, phenol resin, silicate resin, urethane resin, imide resin, acrylic resin, polyester resin, polyethylene resin, etc., may also be used, for example. Also, the resin material may be a combination of multiple resins selected from the above.

The soaking process may be performed in an ambience where the pressure has been reduced to a level lower than the atmospheric pressure. This way, the solution of resin material can penetrate fully throughout the entire magnetic body part 12 over a short period. Also, in the soaking process, a resin material in a liquid form may be used instead of a solution containing resin material.

In the wiping process, the solution containing resin material that has attached to the surface of the magnetic body part 12 and the base layers of the external electrodes 14 and 15 in the soaking process is wiped off. In the drying process, the solvent component in the solution of resin material that has been filled in the magnetic body part 12 after the wiping process, evaporates. The drying process can be implemented under conditions of keeping a temperature of approx. 150° C. for approx. 60 minutes, for example.

This way, the pores in the magnetic body part 12 can be partially filled with the resin material. In other words, the resin material is arranged around the soft magnetic grains G1, G2, and G3 constituting the magnetic body part 12. This suppresses conduction between the adjacent soft magnetic grains G1, G2, and G3, and the insulation property of the magnetic body part 12 improves as a result.

Also, filling the resin material into the pores in the magnetic body part 12 improves the mechanical strength of the main body 11. Furthermore, moisture no longer easily enters the pores filled with the resin material, which means that the hygroscopicity of the magnetic body part 12 is suppressed. As a result, the insulation property of the magnetic body part 12 does not drop easily due to entry of moisture into the magnetic body part 12.

It should be noted that the constitution of the resin-impregnation step is not limited to the foregoing. For example, a series of processes, i.e., the soaking process, the wiping process, and the drying process, may be repeated multiple times in the resin-impregnation step. This improves the filling rate of the resin material into the pores in the magnetic body part 12.

1.4 Variation Example 1

Figure 9:
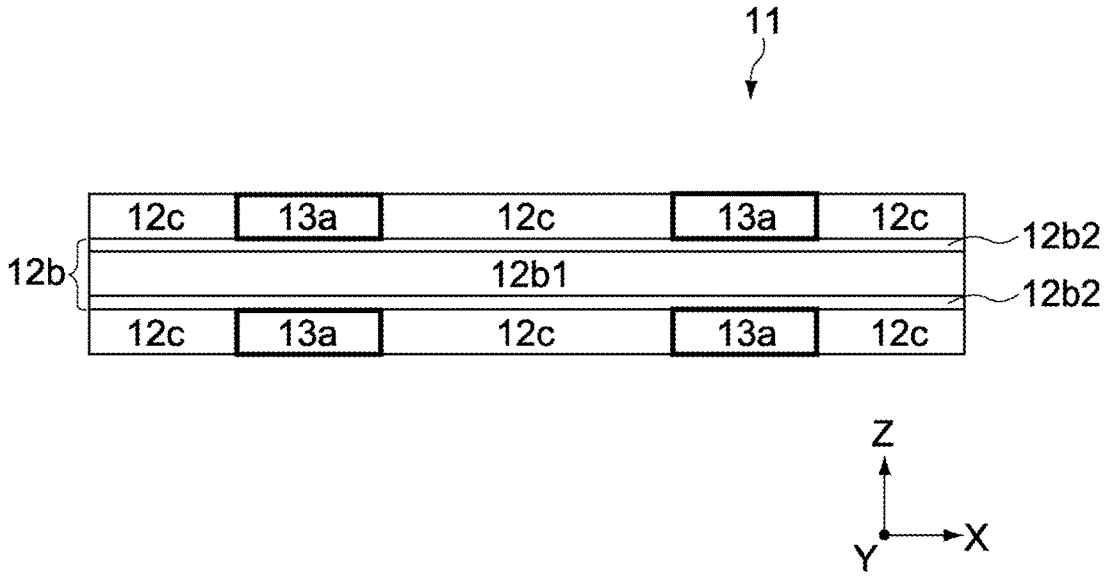
FIG. 9 is a schematic view showing the main body of the coil component pertaining to Variation Example 1 of the first embodiment.

FIG. 9 is a schematic view showing a part of the main body 11 of the coil component 10 pertaining to Variation Example 1 of the first embodiment. In FIG. 9, one layer of the first magnetic layers 12*b*, and two layers of the second magnetic layers 12*c* adjoining the one layer on the top and the bottom in the Z-axis direction, are extracted and shown. The coil component 10 pertaining to Variation Example 1 differs from the aforementioned embodiment only in the constitution of the first magnetic layers 12*b*.

Each of the first magnetic layers 12*b* pertaining to Variation Example 1 has one of oblate soft magnetic grain-containing layers 12*b*1 and two of fine grain layers 12*b*2. The respective fine grain layers 12*b*2 are arranged on the top face and the bottom face of each of the oblate soft magnetic grain-containing layers 12*b*1 in the Z-axis direction. It should be noted that only one of the fine grain layers 12*b*2 may be arranged on either the top face or the bottom face of each of the oblate soft magnetic grain-containing layers 12*b*1 in the Z-axis direction. The thickness of each of the fine grain layers 12*b*2 may be set to less than 1 μm, for example.

Figure 10A:
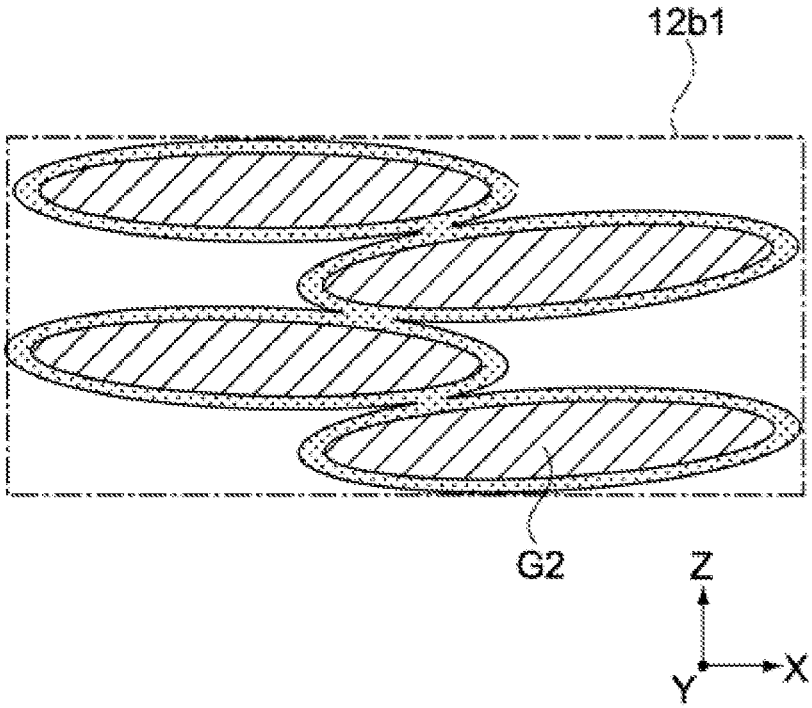
FIGS. 10A and 10B are schematic views showing a micro-structure of each of the oblate soft magnetic grain-containing layers of the first magnetic layers of the coil component.
Figure 10B:
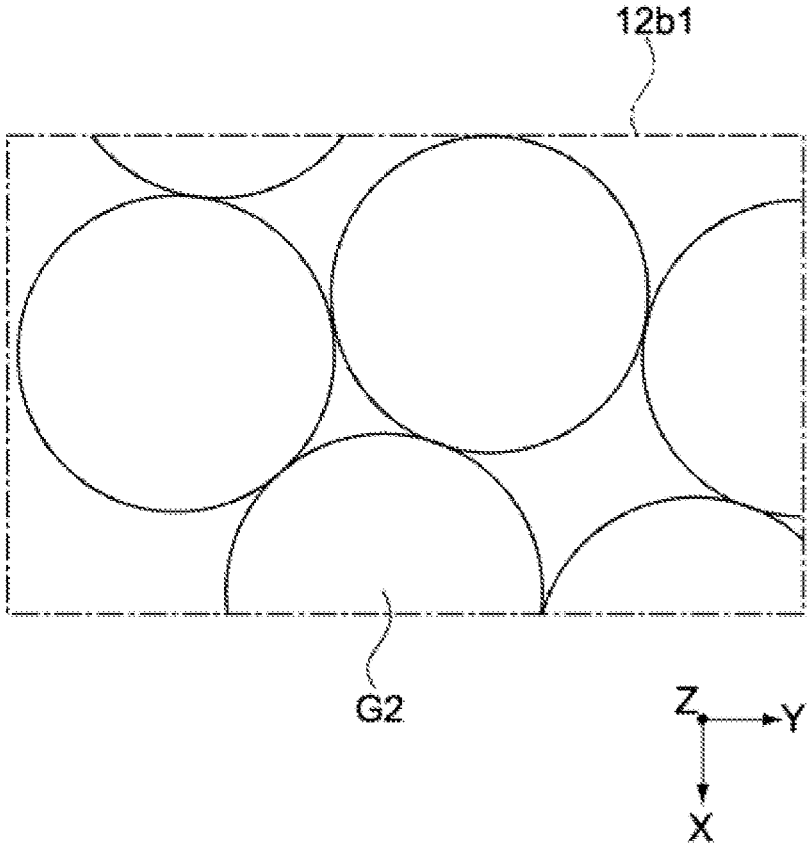

FIG. 10A is a schematic view showing a micro-structure of a cross-section of each of the oblate soft magnetic grain-containing layers 12*b*1. FIG. 10B is a schematic view showing the positions of the soft magnetic grains G2 using their outlines, when the micro-structure of each of the oblate soft magnetic grain-containing layers 12*b*1 is viewed from the Z-axis direction. Each of the oblate soft magnetic grain-containing layers 12*b*1 is formed by the oblate soft magnetic grains G2, and the fine soft magnetic grains G3 are not arranged in the gaps between the soft magnetic grains G2.

Because of this, each of the oblate soft magnetic grain-containing layers 12*b*1 tends to have paths penetrating through it in the Z-axis direction due to the gaps formed between the soft magnetic grains G2, as shown in FIG. 10B. As a result, a constitution having only the oblate soft magnetic grain-containing layers 12*b*1 makes it vulnerable to shorting of the layers in the Z-axis direction through the gaps between the soft magnetic grains G2.

Figure 11A:
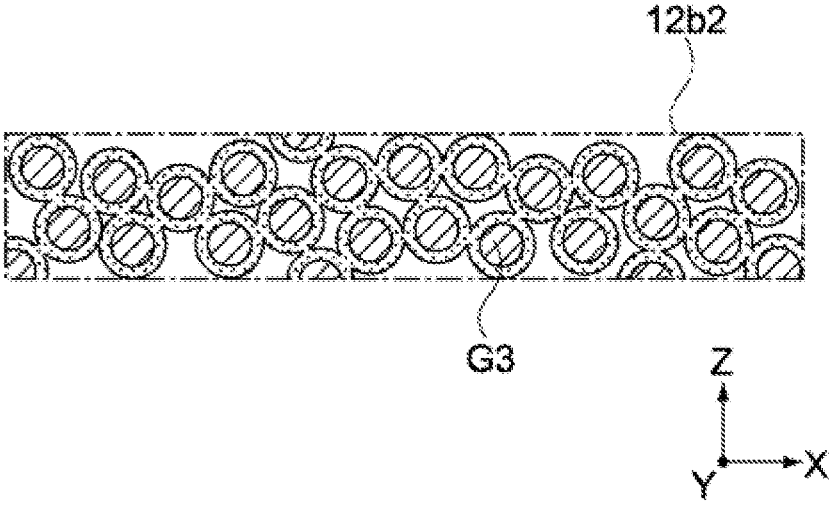
FIGS. 11A and 11B are schematic views showing a micro-structure of each of the fine grain layers of the first magnetic layers of the coil component.
Figure 11B:
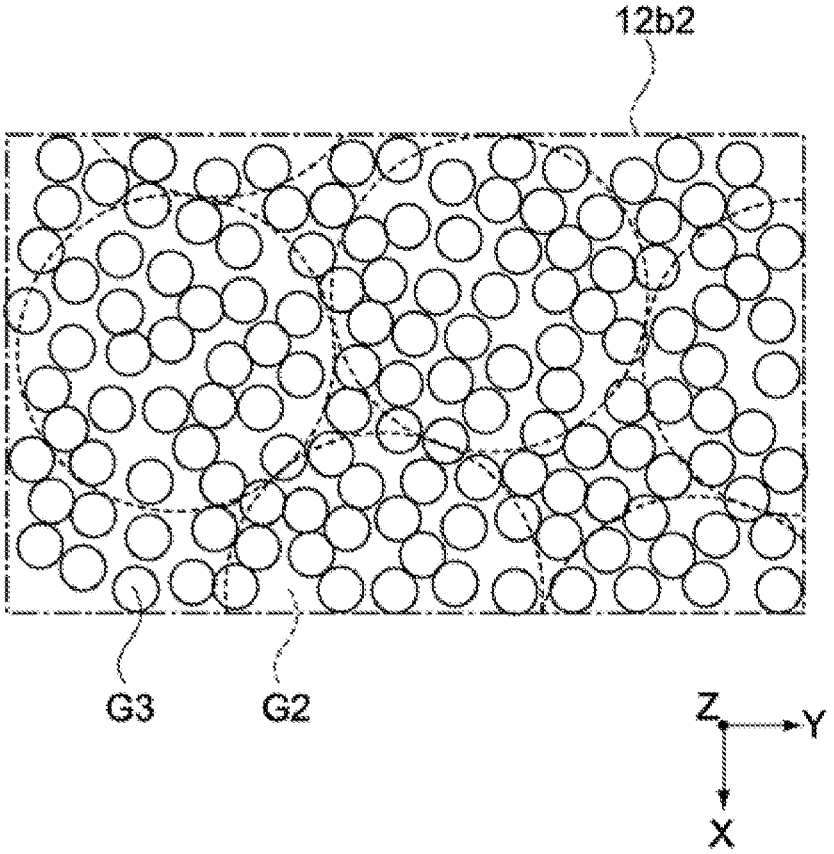

FIG. 11A is a schematic view showing a micro-structure of a cross-section of each of the fine grain layers 12*b*2. FIG. 11B is a schematic view showing the positions of the soft magnetic grains G3 using their outlines, when the micro-structure of each of the fine grain layers 12*b*2 is viewed from the Z-axis direction. In FIG. 11B, only the soft magnetic grains G3 in the surface of each of the fine grain layers 12*b*2 are shown, and the positions of the soft magnetic grains G2 constituting each of the oblate soft magnetic grain-containing layers 12*b*1 are shown by broken lines, for the sake of explanation.

Each of the fine grain layers 12*b*2 is a spherical grain-containing layer formed by the soft magnetic grains G3 that are fine spherical grains. Because of this, each of the fine grain layers 12*b*2 has no large gaps that are likely to form paths penetrating through it in the Z-axis direction, as shown in FIG. 11B. In other words, each of the fine grain layers 12*b*2 functions as a blocking part that at least partially blocks the gaps between the soft magnetic grains G2 from entry of conductive paste in each of the oblate soft magnetic grain-containing layers 12*b*1 from the Z-axis direction.

As described above, the operation of the fine grain layers 12*b*2 makes it difficult for the first magnetic layers 12*b* to have paths penetrating through the first magnetic layers 12*b* in the Z-axis direction, and this in turn prevents shorting of the first magnetic layers 12*b* in the Z-axis direction. Also, the soft magnetic grains G3 constituting the fine grain layers 12*b*2 contribute to the magnetic permeability of the first magnetic layers 12*b*, and the inductance of the coil component 10 improves as a result.

It should be noted that, although preferably the soft magnetic grains G3 are used for the fine grain layers 12*b*2, insulating fine grains not having magnetic property can also be used, instead of the soft magnetic grains G3. The use of insulating fine grains is disadvantageous from the viewpoint of magnetic permeability of the first magnetic layers 12*b*, but it can give insulation property to the first magnetic layers 12*b* in a more reliable manner.

Figure 12:
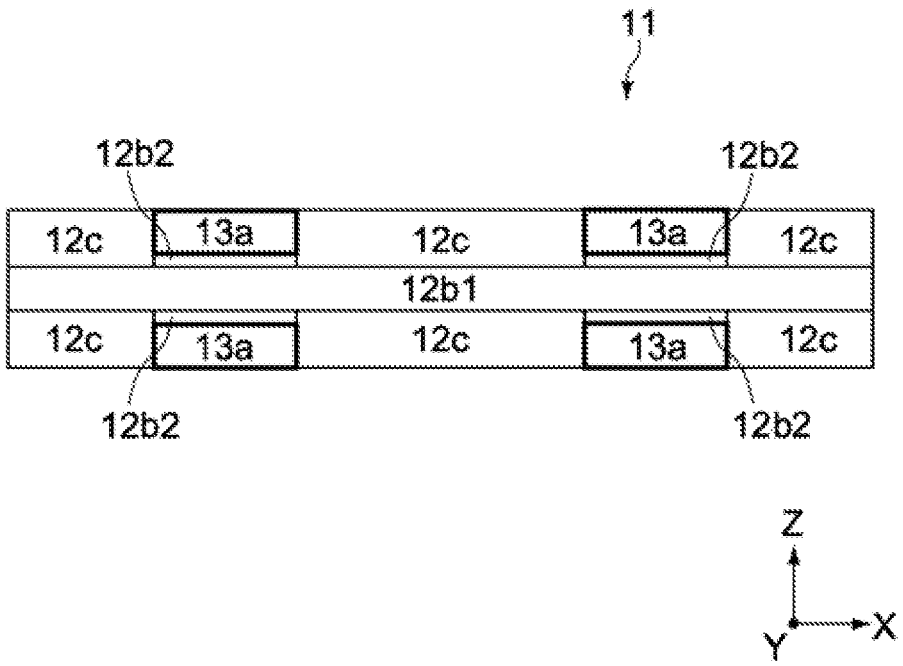
FIG. 12 is a schematic view showing a different mode of the main body of the coil component.

Also, as shown in FIG. 12, the fine grain layers 12*b*2 may be provided in patterns similar to the conductor patterns 13*a*, and only in positions adjacent to the conductor patterns 13*a*. As described above, shorting of the first magnetic layers 12*b* in the Z-axis direction tends to occur due to entry of the conductor paste forming the conductor patterns 13 into the gaps in the first magnetic layers 12*b*.

This means that, so long as the fine grain layers 12*b*2 are arranged at least in positions adjacent to the conductor patterns 13*a*, as shown in FIG. 12, shorting of the first magnetic layers 12*b* in the Z-axis direction can be prevented in an effective manner. It should be noted that the patterns of the fine grain layers 12*b*2 on the oblate soft magnetic grain-containing layers 12*b*1 can be changed as deemed appropriate.

Also, the soft magnetic grains G3 may be arranged between the soft magnetic grains G2 in the oblate soft magnetic grain-containing layers 12*b*1, just like in the aforementioned embodiment. This way, shorting of the first magnetic layers 12*b* in the Z-axis direction can be prevented in a more effective manner. Also, the magnetic permeability of the first magnetic layers 12*b* improves, and the inductance of the coil component 10 improves as a result.

1.5 Variation Example 2

Figure 13A:
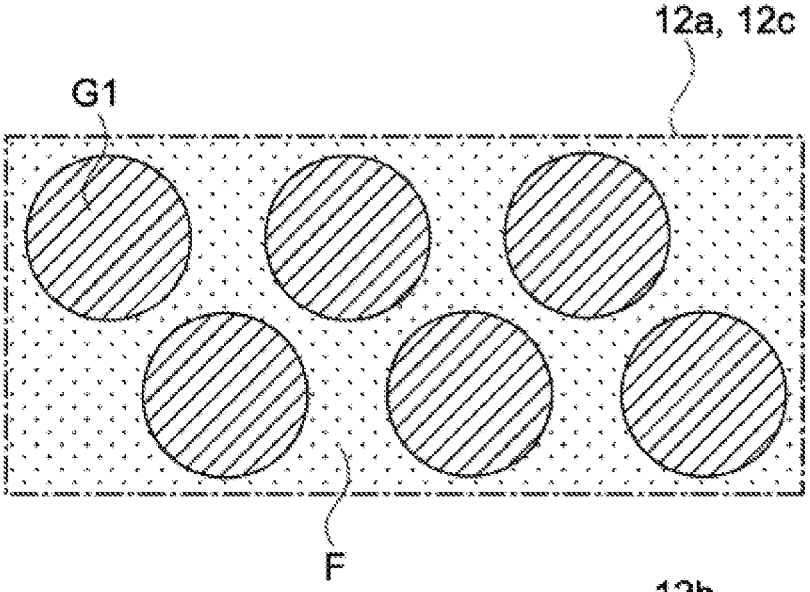
FIGS. 13A and 13B are schematic views showing a micro-structure of a cross-section of the magnetic body part of the coil component pertaining to Variation Example 2 of the first embodiment.
Figure 13B:
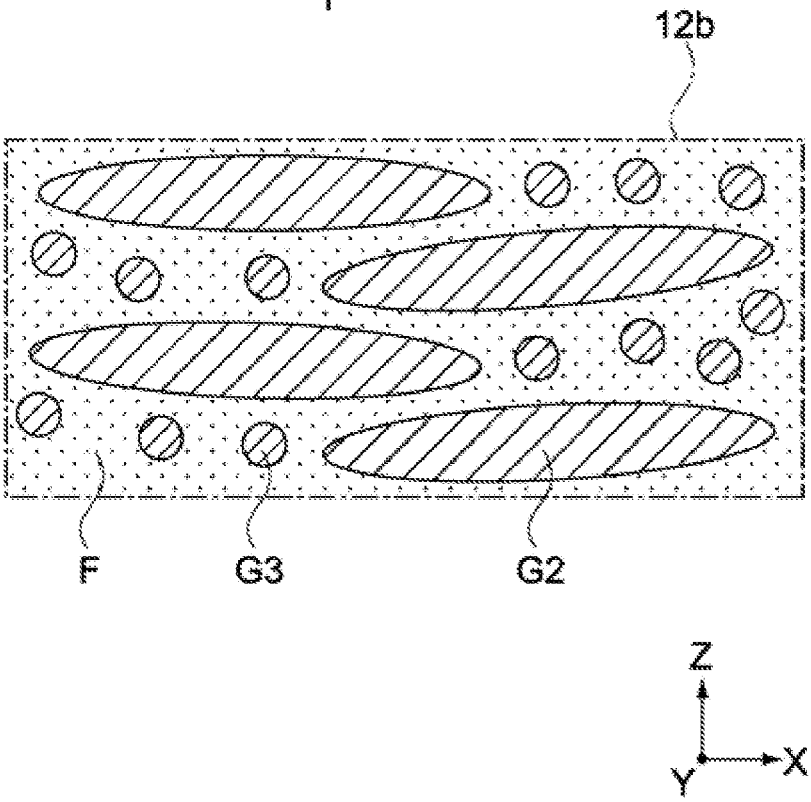

FIG. 13 is a schematic view showing a micro-structure of a cross-section of the magnetic body part 12 pertaining to Variation Example 2 of the first embodiment. Each of the cover parts 12*a* and second magnetic layers 12*c* shown in FIG. 13A is constituted by the soft magnetic grains G1 and a resin F covering the soft magnetic grains G1. Each of the first magnetic layers 12*b* shown in FIG. 13B is constituted by soft magnetic grains G2 and G3 and the resin F covering the soft magnetic grains G2 and G3.

Unlike in the aforementioned embodiment, oxide films need not be formed on the soft magnetic grains G1, G2, and G3 pertaining to Variation Example 2. However, the soft magnetic grains G1, G2, and G3 are distributed in the resin F and thus insulated by the resin F instead of conducting with each other. Needless to say, the soft magnetic grains G1, G2, and G3 may have oxide films formed on them and may also be covered by the resin F. This means that, either way, insulation property is ensured for the magnetic body part 12 pertaining to Variation Example 2.

For the resin material constituting the resin F, silicon resin, epoxy resin, phenol resin, silicate resin, urethane resin, imide resin, acrylic resin, polyester resin, polyethylene resin, etc., may be used, for example. Also, the resin F may be constituted by a combination of multiple resin materials selected from the foregoing.

Since the shapes of the soft magnetic grains G1, G2, and G3 pertaining to Variation Example 2 are similar to those in the aforementioned embodiment, the coil component 10 having the magnetic body part 12 pertaining to Variation Example 2 can also achieve effects similar to those achieved in the aforementioned embodiment.

1.6 Examples

In Examples 1-1 through 1-6, samples of the coil component 10 having the first magnetic layers 12*b* were produced according to the constitution shown in FIGS. 5 to 6B. In Examples 1-1 through 1-6, the quantity of the soft magnetic grains G3 relative to the total quantity of the soft magnetic grains G2 and G3 used for forming the first magnetic layers 12*b*, was changed in various ways.

The samples pertaining to Examples 1-1 through 1-6 were constitutionally identical except for the first magnetic layers 12*b*, and had dimensions of 1.6×0.8×0.8 mm. Also, all samples had a total thickness of 0.5 mm for the cover parts 12*a*, and a thickness of 0.3 mm for a coil winding part where the coil part 13 was arranged. In other words, a sample with a smaller thickness of sheets constituting the coil winding part had a greater number of windings in the coil part 13.

In Examples 1-1 through 1-6, the soft magnetic grains G2 with an average longest diameter D of 4 μm and an average thickness T of 1 μm, as well as the spherical soft magnetic grains G3 with an average size of 0.5 μm, were used. To be specific, the quantity of the soft magnetic grains G3 was set to 1 percent by volume in Example 1-1. In Example 1-2, the quantity of the soft magnetic grains G3 was set to 3 percent by volume. In Example 1-3, the quantity of the soft magnetic grains G3 was set to 5 percent by volume. In Example 1-4, the quantity of the soft magnetic grains G3 was set to 10 percent by volume. In Example 1-5, the quantity of the soft magnetic grains G3 was set to 15 percent by volume. In Example 1-6, the quantity of the soft magnetic grains G3 was set to 17 percent by volume.

Also, in Example 2-1, samples of the coil component 10 having the first magnetic layers 12*b*, including the oblate soft magnetic grain-containing layers 12*b*1 and the fine grain layers 12*b*2, were produced according to the constitution of Variation Example 1 shown in FIGS. 9 to 10B. The samples pertaining to Example 2-1 were constitutionally identical to the samples pertaining to Examples 1-1 through 1-6, except for the first magnetic layers 12*b*.

Each of the oblate soft magnetic grain-containing layers 12*b*1 in each of the first magnetic layers 12*b* was formed, to a sheet thickness of 6 μm, using the soft magnetic grains G2 with an average longest diameter D of 4 μm and an average thickness T of 1 μm. Each of the fine grain layers 12*b*2 in each of the first magnetic layers 12*b* was formed, to a sheet thickness of 2 μm, using the soft magnetic grains G3 with an average size of 0.5 μm, and two such layers were respectively arranged on both faces of each of the oblate soft magnetic grain-containing layers 12*b*1.

Also, the sheet thickness of each of the first magnetic layers 12*b* was set to 10 μm for the samples pertaining to Examples 1-1, 1-2, and 2-1, while the sheet thickness of each of the first magnetic layers 12*b* was set to 5 μm for the samples pertaining to Examples 1-3 through 1-6. Furthermore, the coil part 13 was wound by 10.5 turns for the samples pertaining to Examples 1-1, 1-2, and 2-1, while the coil part 13 was wound by 13.5 turns for the samples pertaining to Examples 1-3 through 1-6.

The respective samples pertaining to Examples 1-1 through 1-6 and 2-1 were evaluated for inductance L and shorting rate. The evaluation results of inductance L and shorting rates of Examples 1-1 through 1-6 and 2-1 are shown in Table 1.

The inductance L was calculated as the average of inductance measured on multiple samples for each of Examples 1-1 through 1-6 and 2-1. The shorting rate was calculated by measuring the electrical resistances of multiple samples for each of Examples 1-1 through 1-6 and 2-1 and then obtaining the ratio of the number of shorted samples to the total number of samples.

TABLE 1

| | Quantity of G3 | Sheet thickness | Number of windings | L | Shorting rate |
|---|---|---|---|---|---|
| Example 1-1 | 1 vol % | 10 μm | 10.5 turns | 1.21 μH | 0% |
| Example 1-2 | 3 vol % | 10 μm | 10.5 turns | 1.24 μH | 0% |
| Example 1-3 | 5 vol % | 5 μm | 13.5 turns | 1.50 μH | 0% |
| Example 1-4 | 10 vol % | 5 μm | 13.5 turns | 1.54 μH | 0% |
| Example 1-5 | 15 vol % | 5 μm | 13.5 turns | 1.54 μH | 0% |
| Example 1-6 | 17 vol % | 5 μm | 13.5 turns | 1.33 μH | 0% |
| Example 2-1 | — | 10 μm | 10.5 turns | 1.02 μH | 0% |

All samples pertaining to Examples 1-1 through 1-6 and 2-1 had an inductance L of 1.0 pH or more. Also, none of the samples in Examples 1-1 through 1-6 and 2-1 shorted. This confirms that, in all of Examples 1-1 through 1-6 and 2-1, coil components 10 with high performance and reliability were obtained.

1.7 Comparative Examples

In Comparative Examples 1 through 4, samples of a coil component having first magnetic layers formed only by spherical soft magnetic grains, without using oblate soft magnetic grains, were produced. Also, in Comparative Examples 5 and 6, samples of a coil component having first magnetic layers formed only by oblate soft magnetic grains were produced. The samples pertaining to Comparative Examples 1 through 6 were constitutionally identical to the samples pertaining to Examples 1-1 through 1-6 and 2-1, except for the first magnetic layers.

Soft magnetic grains with an average size of 4 μm were used in Comparative Examples 1 and 2, soft magnetic grains with an average size of 2 μm were used in Comparative Examples 3 and 4, and oblate soft magnetic grains with the average longest diameter D of 4 μm and the average thickness T of 1 μm were used in Comparative Examples 5 and 6.

Also, the sheet thickness of each of the first magnetic layers was set to 15 μm in Comparative Example 1, the sheet thickness of each of the first magnetic layers was set to 10 μm in Comparative Examples 2, 3, and 6, and the sheet thickness of each of the first magnetic layers was set to 5 μm in Comparative Examples 4 and 5. Furthermore, the coil part was wound by 8.5 turns for the samples pertaining to Comparative Example 1, the coil part was wound by 10.5 turns for the samples pertaining to Comparative Examples 2, 3, and 6, and the coil part was wound by 13.5 turns for the samples pertaining to Comparative Examples 4 and 5.

The respective samples pertaining to Comparative Examples 1 through 6 were evaluated for inductance L and shorting rate, according to the same methods used in Examples 1-1 through 1-6 and 2-1. The evaluation results of inductance L and shorting rates of Comparative Examples 1 through 4 are shown in Table 2.

TABLE 2

| | Grain | Sheet thickness | Number of windings | L | Shorting rate |
|---|---|---|---|---|---|
| Comparative Example 1 | Spherical, 4 μm | 15 μm | 8.5 turns | 0.98 μH | 0% |
| Comparative Example 2 | Spherical, 4 μm | 10 μm | 10.5 turns | — | 30% |
| Comparative Example 3 | Spherical, 2 μm | 10 μm | 10.5 turns | 0.75 μH | 0% |
| Comparative Example 4 | Spherical, 2 μm | 5 μm | 13.5 turns | — | 40% |
| Comparative Example 5 | Oblate | 5 μm | 13.5 turns | — | 90% |
| Comparative Example 6 | Oblate | 10 μm | 10.5 turns | — | 65% |

The samples pertaining to Comparative Example 1 had a low inductance L of less than 1 μH because the sheet thickness of each of the first magnetic layers was great, and the number of windings in the coil part was small. Pertaining to Comparative Example 2, where the sheet thickness was reduced to as thin as 10 μm to successfully increase the number of windings in the coil part, some of the samples shorted.

With the samples pertaining to Comparative Example 3, soft magnetic grains whose average size was smaller than that in Comparative Examples 1 and 2 were used to successfully increase the number of windings in the coil part without causing shorting. In Comparative Example 3, however, the surface area of each grain became smaller because the average size of soft magnetic grains was smaller, and consequently the grains gelatinized in the sheet forming step and became difficult to handle. Also, the samples pertaining to Comparative Example 3 had a low inductance L of less than 1 pH because reducing the average size of soft magnetic grains lowered the ratio of parts having magnetic property in the first magnetic layers.

Pertaining to Comparative Example 4 where the sheet thickness was reduced to as thin as 5 μm in order to improve the inductance L, and therefore the number of windings in the coil part was successfully increased further, some of the samples shorted. The results of Comparative Examples 1 through 4 confirm that there are limits to how much inductance L can be improved by changing the size of the spherical soft magnetic grains forming the first magnetic layers.

Accordingly, for the samples pertaining to Comparative Examples 5 and 6, each of the first magnetic layers was formed using oblate soft magnetic grains by changing the shape, not the size, of soft magnetic grains. This ensured large surface area for the oblate soft magnetic grains, and consequently Comparative Examples 5 and 6 no longer presented problems with handling due to gelatinization of grains in the sheet forming step, etc. However, some of the samples pertaining to Comparative Examples 5 and 6 shorted, because large gaps were easily generated between the oblate soft magnetic grains in each of the first magnetic layers.

As described above, inductance L of 1 pH or higher could not be achieved in Comparative Examples 1 through 6 where each of the first magnetic layers was formed using only spherical soft magnetic grains or only oblate soft magnetic grains, even when shorting was constitutionally prevented.

On the other hand, as described above, none of the samples pertaining to Examples 1-1 through 1-6 and 2-1 shorted, and all of the samples achieved an inductance L of 1 pH or higher. This effectively confirms that high inductance L can be obtained, without causing shorting, through combined use of the oblate soft magnetic grains G2 and the spherical soft magnetic grains G3 to form each of the first magnetic layers 12*b*.

2. Second Embodiment

2.1 Overall Constitution

Figure 14:
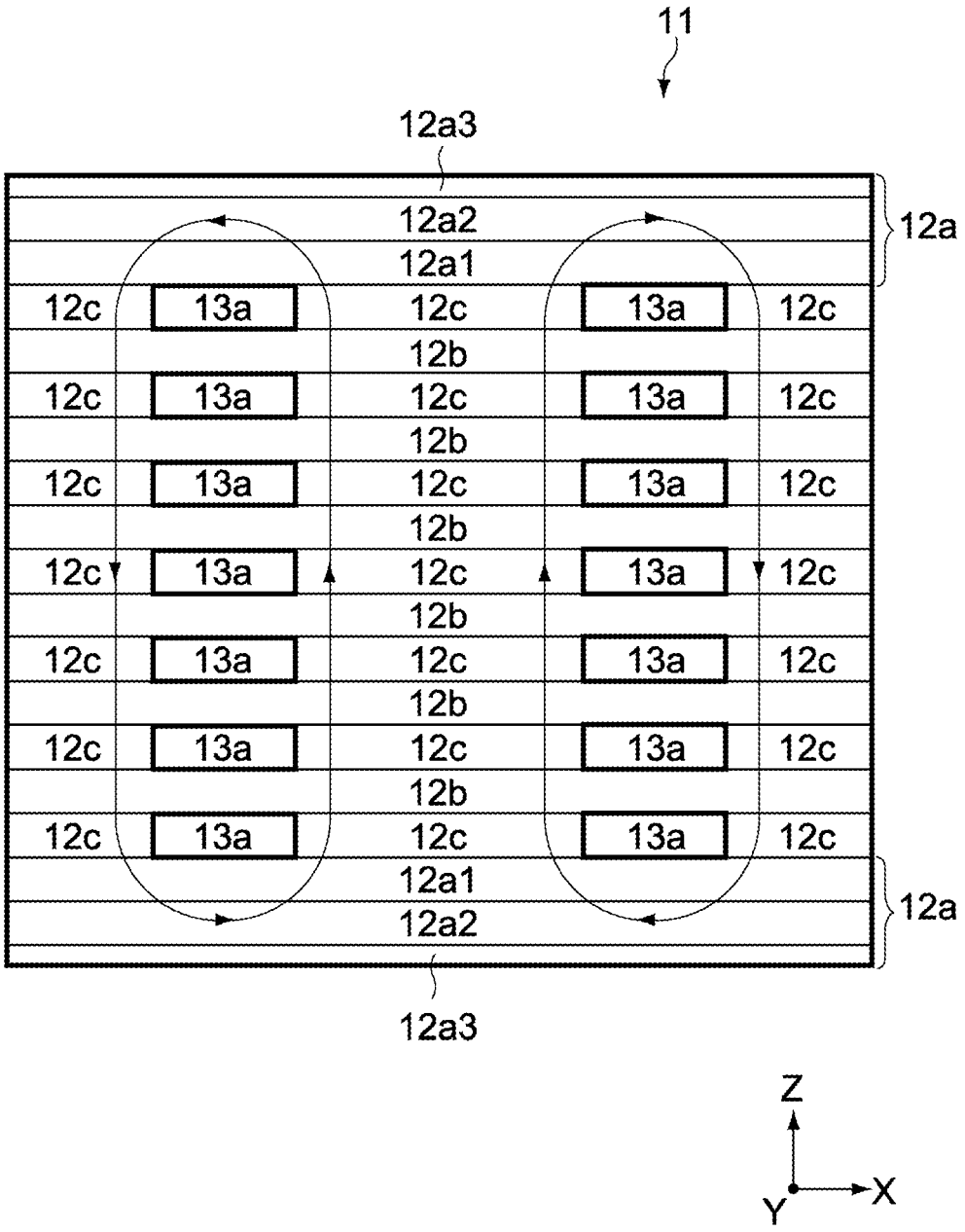
FIG. 14 is schematic view showing a cross-section of the coil component pertaining to the second embodiment of the present invention.

FIG. 14 is a schematic view showing a cross-section of the main body 11 of the coil component 10 pertaining to the second embodiment of the present invention. The coil component 10 pertaining to this embodiment is constitutionally identical to the coil component 10 pertaining to the first embodiment, except for the constitutions explained below. In the following explanations, the same symbols are used for the constitutions corresponding to those in the first embodiment.

With the coil component 10 pertaining to this embodiment, the constitution of the cover parts 12*a* is different from that of the coil component 10 pertaining to the first embodiment. Each of the cover parts 12*a* of the coil component 10 pertaining to this embodiment has a three-layer structure having each of first cover layers 12*a*1, each of second cover layers 12*a*2, and each of third cover layers 12*a*3, all of which are stacked in the Z-axis direction.

Each of the first cover layers 12*a*1 in each of the cover parts 12*a* is arranged on the innermost side in the Z-axis direction and adjoins the outer side, in the Z-axis direction, of the area where the coil part 13 is arranged. Each of the second cover layers 12*a*2 adjoins the outer side of each of the first cover layers 12*a*1 in the Z-axis direction. Each of the third cover layers 12*a*3 further adjoins the outer side of each of the second cover layers 12*a*2 in the Z-axis direction.

The cover layers 12*a*1, 12*a*2, and 12*a*3 extend over the entire range of the main body 11 along the XY plane, and are exposed from the main body 11 in the X-axis and Y-axis directions. This way, the coil component 10 can be manufactured at lower cost using simpler manufacturing processes compared to when it is constituted so that each cover layer is arranged only in some areas of the main body along the XY plane.

Also, according to the constitution where each cover layer is arranged only in some areas of the main body along the XY plane, ensuring accuracy becomes difficult when the size of the coil component in the Z-axis direction is set to 1 mm or less. In this regard, the coil component 10 pertaining to this embodiment can be manufactured with high accuracy even when its dimension in the Z-axis direction is set to 1 mm or less, or even when the dimension in the Z-axis direction is set to 0.8 mm or less.

Figure 15A:
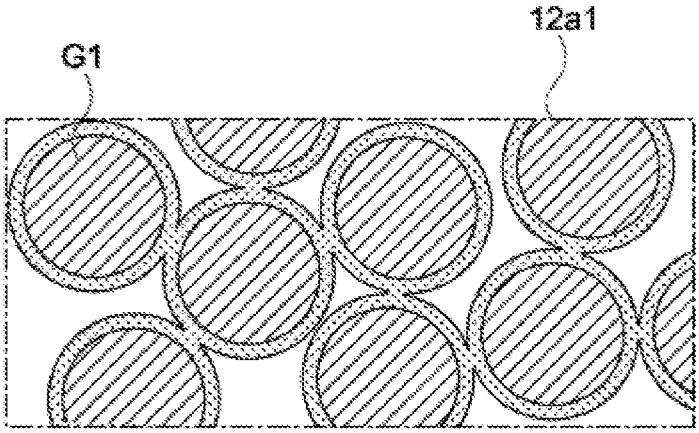
FIGS. 15A to 15C are schematic views showing a micro-structure of a cross-section of each of the cover parts of the coil component.
Figure 15B:
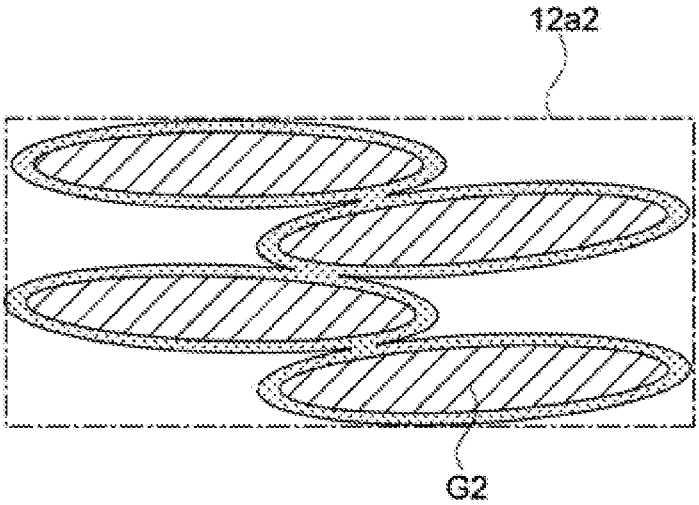
Figure 15C:
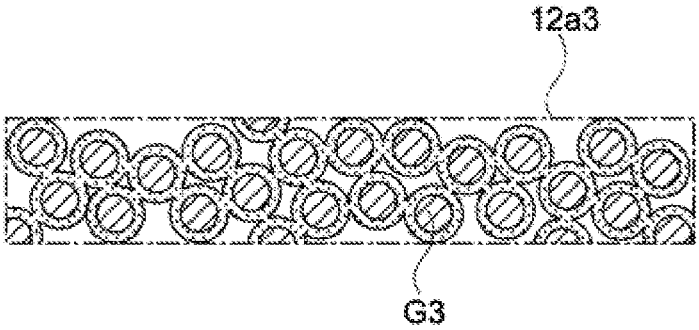
Figure 15C:
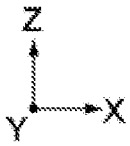

FIGS. 15A to 15C are schematic views showing a microstructure of a cross-section of each of the cover parts 12*a*. FIG. 15A shows each of the first cover layers 12*a*1, FIG. 15B shows each of the second cover layers 12*a*2, and FIG. 15C shows each of the third cover layers 12*a*3. The soft magnetic grains constituting each of the cover layers 12*a*1, 12*a*2, and 12*a*3 have different shapes.

As shown in FIG. 15A, each of the first cover layers 12*a*1 in each of the cover parts 12*a* is constituted by the spherical soft magnetic grains G1 having a relatively large average size. The adjacent soft magnetic grains G1 are bonded to each other via the oxide films on their surfaces.

As shown in FIG. 15B, each of the second cover layers 12*a*2 in each of the cover parts 12*a* is constituted as an oblate soft magnetic grain-containing layer in which the oriented oblate soft magnetic grains G2 are arranged over its entire area. The adjacent soft magnetic grains G2 are bonded to each other via the oxide films on their surfaces.

Each of the second cover layers 12*a*2 is formed by a magnetic sheet containing an oblate-grained metal magnetic powder, for example. The thickness of the magnetic sheet is approx. three to ten times the average thickness of the grains of the metal magnetic powder, or preferably approx. one-tenth the average longest diameter of the grains of the metal magnetic powder. This way, each of the second cover layers 12*a*2 in which the oblate soft magnetic grains G2 are oriented in a favorable manner can be achieved.

As shown in FIG. 15C, each of the third cover layers 12*a*3 in each of the cover parts 12*a* is constituted by the fine soft magnetic grains G3. In other words, the soft magnetic grains G3 are arranged at high density in each of the third cover layers 12*a*3. The adjacent soft magnetic grains G3 are bonded to each other via the oxide films on their surfaces.

It should be noted that the soft magnetic grains G1, G2, and G3 may be formed not by the same material, but by different materials. Furthermore, the soft magnetic grains G1, G2, and G3 are not limited to a constitution where they are formed by a soft magnetic alloy containing Fe, Si, and at least one of Cr and Al; instead, they may be formed by other soft magnetic material.

For example, at least one type of the soft magnetic grains G1, G2, and G3 may be amorphous alloy grains. This way, the eddy current loss in the coil component 10 can be reduced. Also, at least one type of the soft magnetic grains G1, G2, and G3 may be ferrite grains that can be easily flattened or made finer.

2.2 Details of Cover Parts 12*a*

The following explains the details of the cover layers 12*a*1, 12*a*2, and 12*a*3 in the cover parts 12*a* pertaining to this embodiment. It should be noted that each of the cover parts 12*a* may include a constitution other than the cover layers 12*a*1, 12*a*2, and 12*a*3, if necessary.

2.2.1 First Cover Layers 12*a*1

Each of the first cover layers 12*a*1 has a function to form magnetic paths in each of the cover parts 12*a*, for example. In each of the first cover layers 12*a*1, use of the soft magnetic grains G1 in an appropriate size achieves high magnetic permeability, while ensuring high insulation property. From this viewpoint, preferably the average size of the soft magnetic grains G1 is 2 μm or more but 6 μm or less.

Preferably the thickness of each of the first cover layers 12*a*1 is 10 μm or more from the viewpoint of ensuring magnetic paths. Also, more preferably the thickness of each of the first cover layers 12*a*1 is kept to 150 μm or less, or even more preferably it is kept to less than 60 μm, so that the magnetic flux easily reaches each of the second cover layers 12*a*2 on the outer side of each of the first cover layers 12*a*1.

It should be noted that, while the soft magnetic grains G1 shown in FIG. 15A have a uniform shape, the soft magnetic grains G1 may have a prescribed granularity distribution, and the soft magnetic grains G1 may also have non-uniform shapes.

2.2.2 Second Cover Layers 12*a*2

The oblate soft magnetic grains G2 constituting each of the second cover layers 12*a*2 have anisotropic magnetic permeability, thereby exhibiting higher magnetic permeability in the direction along the XY-plane and lower magnetic permeability in the direction along the Z-axis. Accordingly, the magnetic permeability of each of the second cover layers 12*a*2 is higher in the direction along the XY-plane and lower in the Z-axis direction.

This means that the magnetic flux entering each of the second cover layers 12*a*2 passes through each of the second cover layers 12*a*2 by changing their orientation to the direction along the XY-plane. As a result, the magnetic flux shifts toward the inner side in the Z-axis direction, in each of the second cover layers 12*a*2. This improves the magnetic flux density in the cover parts 12*a*, which in turn improves the inductance of the coil component 10.

Also, in each of the second cover layers 12*a*2, the lower magnetic permeability in the Z-axis direction makes it difficult for the magnetic flux to pass through toward the outer side in the z-axis direction. Accordingly, the second cover layers 12*a*2 function as a shield to prevent leakage of magnetic flux toward the outer side in the Z-axis direction. This improves the inductance of the coil component 10 further.

Preferably the soft magnetic grains G2 have as uniform a diameter as possible in the direction perpendicular to the thickness direction, which means that, preferably their shapes approximate a circle when viewed from the thickness direction. The diameter of the soft magnetic grains G2 may be set to approx. 10 μm, for example. Also, preferably the aspect ratio of the soft magnetic grains G2 is 4 or greater.

Also, in each of the second cover layers 12*a*2, magnetic property may also be added to the gaps between the soft magnetic grains G2 by arranging the soft magnetic grains G3 in the gaps between the soft magnetic grains G2 in addition to the constitution shown in FIG. 15B. This way, the magnetic permeability in the second cover layers 12*a*2 improves further, which means that the inductance of the coil component 10 improves further.

Preferably the quantity of the soft magnetic grains G3 relative to the total quantity of the soft magnetic grains G2 and the soft magnetic grains G3, in the second cover layers 12*a*2 based on the constitution using the soft magnetic grains G3, is 5 percent by volume or more but 15 percent by volume or less, such as 8 percent by volume. This way, the soft magnetic grains G3 fill the gaps between the soft magnetic grains G2 in a favorable manner.

The thickness of each of the second cover layers 12*a*2 can be determined in any way deemed appropriate; for example, it can be set to approx. 80 μm. It should be noted that, while the soft magnetic grains G2 shown in FIG. 15B have a uniform shape, the soft magnetic grains G2 may also have non-uniform shapes.

2.2.3 Third Cover Layers 12*a*3

When the outermost layer of each of the cover parts 12*a* is constituted by each of the second cover layers 12*a*2 and the oblate soft magnetic grains G2 are exposed on the surface of each of the cover parts 12*a*, the insulation property at the surface of each of the cover parts 12*a* drops. As the insulation property at the surface of the magnetic body part 12 drops, plating extension tends to occur in the plating step. As a result, the reliability of the coil component 10 drops.

To prevent such problem from occurring, the third cover layers 12*a*3 are provided as the outermost layers of the respective cover parts 12*a*. In other words, each of the third cover layers 12*a*3 is constituted by the fine soft magnetic grains G3, and therefore high insulation property can be added to the surface of each of the cover parts 12*a*. This improves the reliability of the coil component 10.

Also, by providing each of the third cover layers 12*a*3 as the outermost layer of each of the cover parts 12*a*, moisture no longer enters the main body 11 easily. This prevents the insulation property of the magnetic body part 12 from dropping easily due to entry of moisture into the magnetic body part 12. As a result, the reliability of the coil component 10 improves further. Preferably the thickness of each of the third cover layers 12*a*3 is 5 μm or less.

It should be noted that the soft magnetic grains G3 constituting the third cover layers 12*a*3 are not limited to a constitution where they are formed by a soft magnetic alloy, and they may be formed by other soft magnetic material. For example, the soft magnetic grains G3 may be ferrite grains formed by ferrite. Since ferrite can be easily made finer, the soft magnetic grains G3 can be obtained easily.

Also, although preferably the soft magnetic grains G3 are used for the third cover layers 12*a*3, insulating fine grains having no magnetic property can also be used, instead of the soft magnetic grains G3. This results in the third cover layers 12*a*3 no longer functioning as magnetic paths, but it can achieve insulation property at the surface of each of the cover parts 12*a* in a more reliable manner.

Furthermore, while the soft magnetic grains G3 shown in FIG. 15C have a uniform shape, the soft magnetic grains G3 may have a prescribed granularity distribution, or the soft magnetic grains G3 may also have non-uniform shapes. Also, the third cover layers 12*a*3 need not be provided in the cover parts 12*a*, so long as insulation property can be ensured on the surfaces of the cover parts 12*a*. In this case, the cover parts 12*a* need not contain any fine grains such as the soft magnetic grains G3.

In addition, the constitutions of the first magnetic layers 12*b* and the second magnetic layers 12*c* pertaining to this embodiment may be different from those of the first magnetic layers 12*b* and the second magnetic layers 12*c* pertaining to the first embodiment, and may be changed arbitrarily. For example, the first magnetic layers 12*b* and the second magnetic layers 12*c* pertaining to this embodiment may both be formed by the spherical soft magnetic grains G1.

3. Third Embodiment

The coil component 10 to which the present invention can be applied is not limited to the multilayer inductors pertaining to the first or second embodiment. In the third embodiment of the present invention, a common mode choke coil is explained as an example of the coil component 10 other than a multilayer inductor. In the following explanations, the same symbols are used for the constitutions corresponding to those in the first embodiment.

Figure 16:
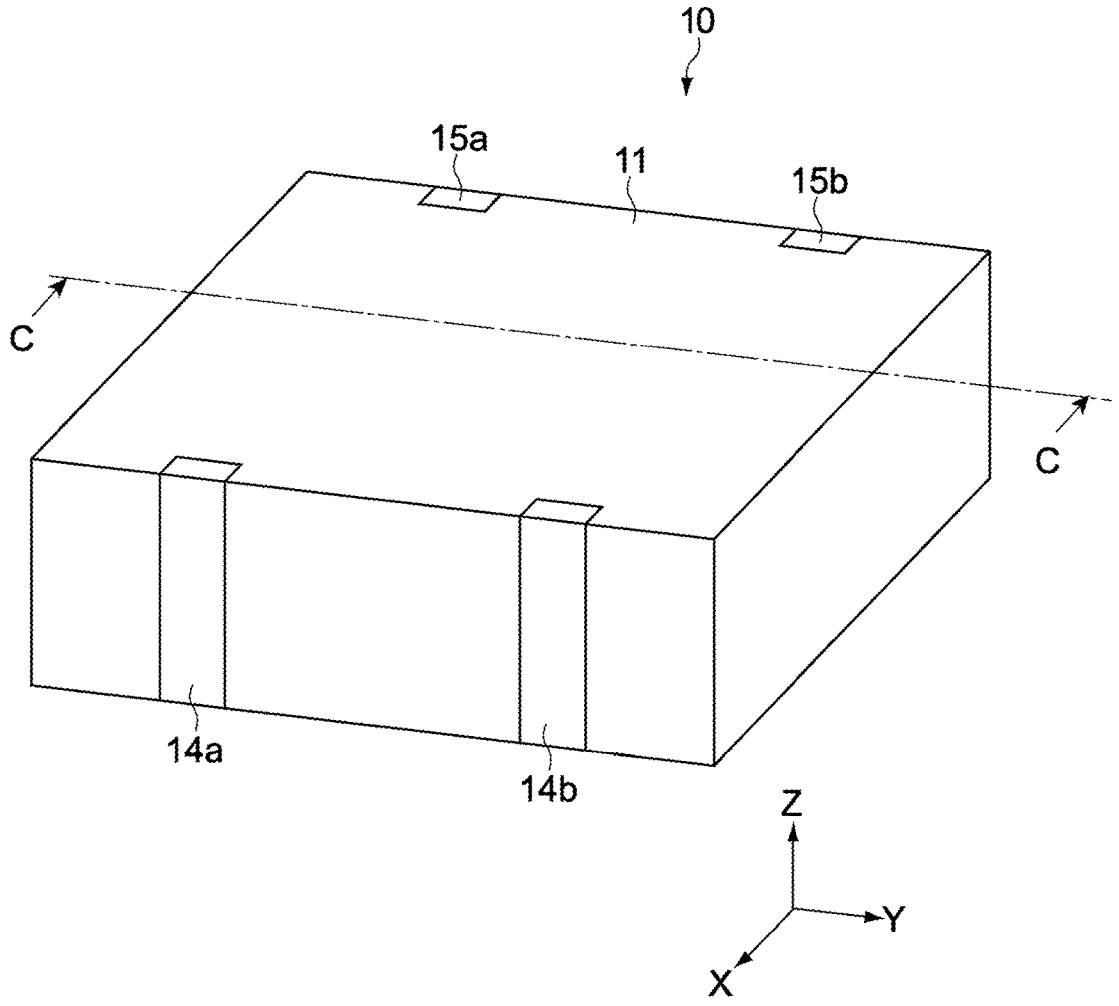
FIG. 16 is an oblique view of the coil component pertaining to the third embodiment of the present invention.

FIG. 16 is an oblique view of the coil component 10 pertaining to the third embodiment. As shown in FIG. 16, four terminals, constituted by two first external electrodes

14*a* and 14*b* and two second external electrodes 15*a* and 15*b*, are provided on the main body 11 of the coil component 10. The external electrodes 14*a* and 15*a* are facing each other, while the external electrodes 14*b* and 15*b* are facing each other.

Figure 17:
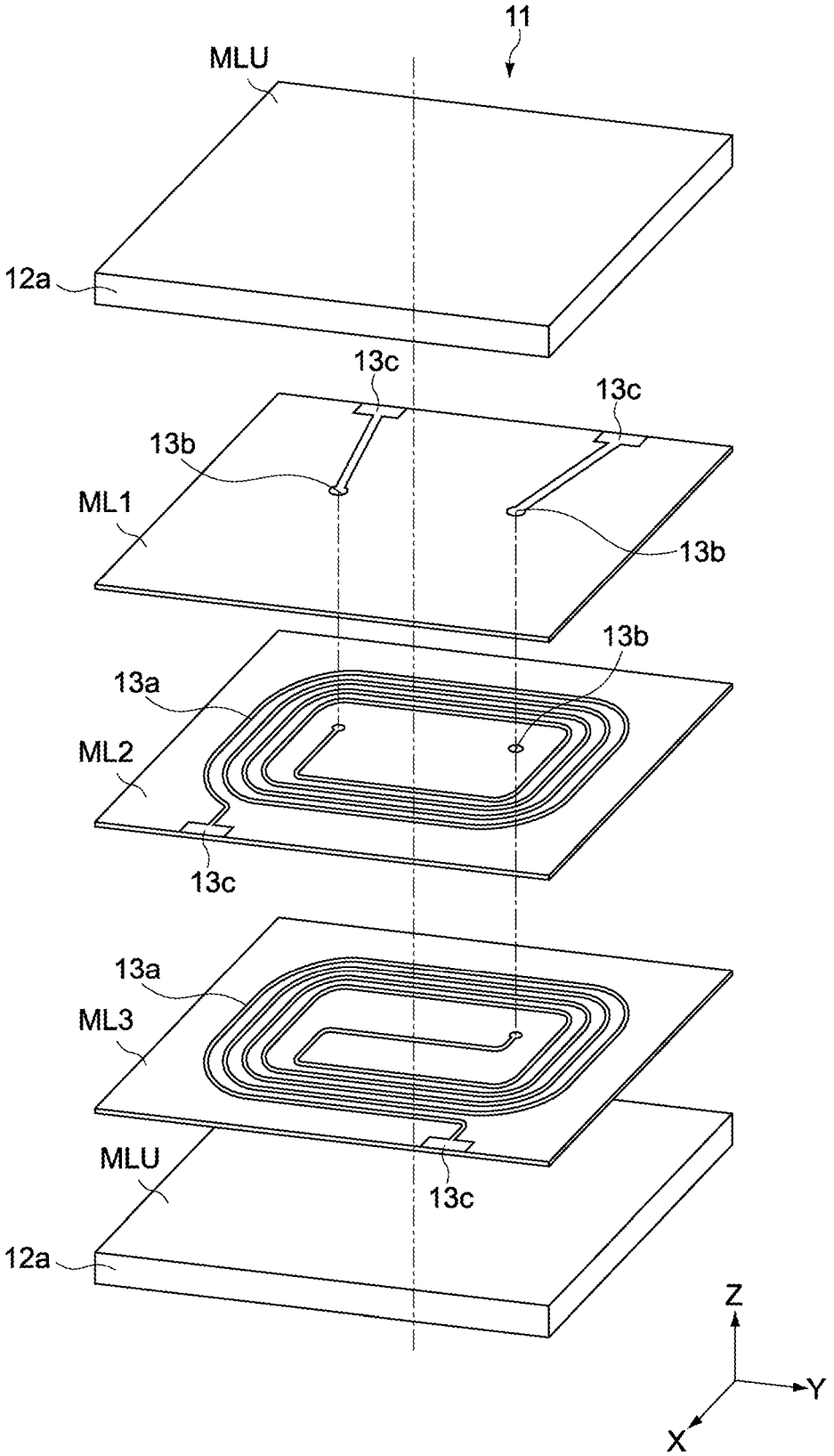
FIG. 17 is an exploded oblique view of the main body of the coil component.

FIG. 17 is an exploded oblique view of the main body 11 of the coil component 10. As shown in FIG. 17, it has a layered structure consisting of layer parts ML1 to ML3 that are arranged between the cover parts 12*a*. The constitution of the cover parts 12*a* may be similar to that in the first or second embodiment, meaning that it may have a single-layer structure or multilayer structure.

The spiral conductor patterns 13*a* constituting the coil part 13 are formed on the layer parts ML2 and ML3 along the top faces in the Z-axis direction. Also, one of the lead ends 13*c* connected to the second external electrode 15*a*, and the other of the lead ends 13*c* connected to the second external electrode 15*b*, are provided on the layer part ML1.

Also, one of the lead ends 13*c* for connecting the outer end of the conductor patterns 13*a* to the first external electrode 14*a*, is provided on the layer part ML2. Also, one of the via holes 13*b* for connecting the inner end of one of the conductor patterns 13*a* on the layer part ML2 to one of the lead ends 13*c* connected to the second external electrode 15*a*, is provided on the layer part ML1.

Furthermore, one of the lead ends 13*c* for connecting the outer end of the conductor patterns 13*a* to the first external electrode 14*b*, is provided on the layer part ML3. Also, one of the via holes 13*b* for connecting the inner end of the conductor patterns 13*a* on the layer part ML3 to one of the lead ends 13*c* connected to the second external electrode 15*b*, is provided on each of the layer part ML1 and the layer part ML2.

Having this constitution, the coil component 10 is configured such that electrical current flows through one of the conductor patterns 13*a* on the layer part ML2 due to the voltage applied to the external electrodes 14*a* and 15*a*, and electrical current flows through one of the conductor patterns 13*a* on the layer part ML3 due to the voltage applied to the external electrodes 14*b* and 15*b*. As a result, the coil component 10 functions as a common mode choke coil.

Figure 18:
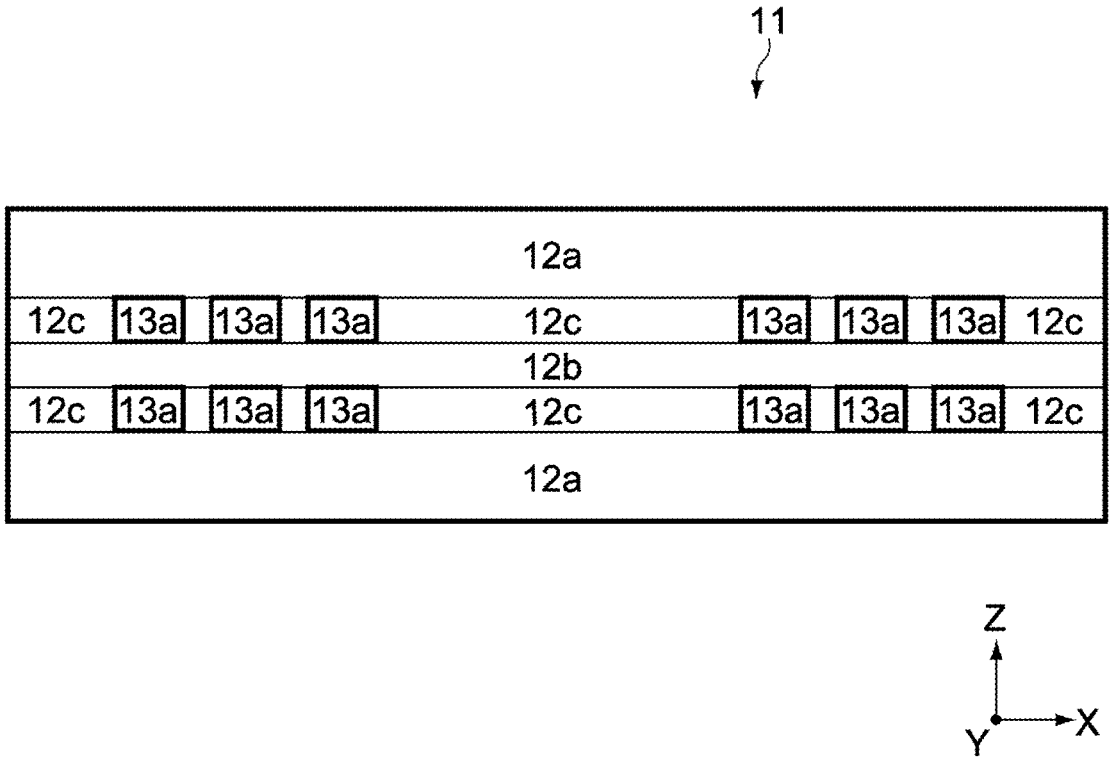
FIG. 18 is a schematic view showing a cross-section of the coil component along line C-C in FIG. 16.

FIG. 18 is a schematic view showing a cross-section of the coil component 10 along line C-C in FIG. 16. The coil component 10 pertaining to this embodiment has commonality with the coil component 10 pertaining to the first or second embodiment in that the magnetic body part 12 is constituted by the cover parts 12*a*, the first magnetic layers 12*b*, and the second magnetic layers 12*c*.

Accordingly, the coil component 10 pertaining to this embodiment can achieve effects similar to those achieved in the first embodiment, by adopting for the first magnetic layers 12*b* a composition similar to that in the first embodiment. Also, the coil component 10 pertaining to this embodiment can achieve effects similar to those achieved in the second embodiment, by adopting for the cover parts 12*a* a composition similar to that in the second embodiment.

4. Other Embodiments

The foregoing explained embodiments of the present invention; however, needless to say, the present invention is not limited to the aforementioned embodiments, and various changes can be added.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2016-239069, filed Dec. 9, 2016, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component comprising:

a magnetic body part having first and second magnetic layers stacked together alternately in a preset axis direction, and a cover part covering at least one side of a magnetic layer composed of the first and second magnetic layers from the preset axis direction; and a coil part having conductor patterns provided in the second magnetic layers;

wherein the magnetic body part including the first and second magnetic layers is comprised of:

oblate soft magnetic grain-containing layers extending over the entire range of the magnetic body part except for the coil part in a direction perpendicular to the preset axis direction, exposed in the direction perpendicular to the preset axis direction, and formed with oblate soft magnetic grains which are flattened in a thickness direction oriented in the preset axis direction; and spherical grain-containing layers adjoining the oblate soft magnetic grain-containing layers in the preset axis direction, and formed with insulative spherical grains, wherein each first magnetic layer is constituted by one of the oblate soft magnetic grain-containing layers, which is interposed, in the preset axis direction, between the second magnetic layers each including a portion of the coil part.

2. The coil component according to claim 1, wherein:

the first magnetic layers contain first spherical grains which are insulative and arranged in gaps between the oblate soft magnetic grains, and whose average size is smaller than the size of the oblate soft magnetic grains in the thickness direction, and the second magnetic layers are constituted by the spherical grain-containing layers.

3. The coil component according to claim 2, wherein, in the first magnetic layers, the quantity of the first spherical grains relative to the total quantity of the oblate soft magnetic grains and the first spherical grains is 5 percent by volume or more, but 15 percent by volume or less.

4. The coil component according to claim 2, wherein the magnetic body part further comprises spherical grain-containing layers interposed between the first magnetic layers and the conductor patterns, and formed with second spherical grains which are insulative and whose average size is smaller than the size of the oblate soft magnetic grains in the thickness direction.

5. The coil component according to claim 2, wherein the thickness of each of the first magnetic layers is less than 10 μm.

6. The coil component according to claim 1, wherein the cover part is constituted by the oblate soft magnetic grain-containing layer(s) and the spherical grain-containing layer (s).

7. The coil component according to claim 6, wherein the cover part is constituted by a first cover layer being one of the spherical grain-containing layers adjoining the outer side of one of the first or second magnetic layers in the preset axis direction, and a second cover layer being one of the oblate soft magnetic grain-containing layers adjoining the outer side of the first cover layers in the preset axis direction.

8. The coil component according to claim 7, wherein the cover part is constituted further by a third cover layer adjoining the outer side of the second cover layer in the preset axis direction.

9. The coil component according to claim 8, wherein the third cover layer is formed with third spherical grains which are insulative and whose average size is smaller than the size of the oblate soft magnetic grains in the thickness direction.

10. The coil component according to claim 1, wherein a ratio of the longest size in the direction perpendicular to the thickness direction, to the size in the thickness direction, of the oblate soft magnetic grains, is 4 or greater.

11. The coil component according to claim 1, wherein at least either one of the oblate soft magnetic grains or the spherical grains is iron alloy grains containing iron, silicon, and at least one of chromium and aluminum.

12. The coil component according to claim 11, wherein an oxide film is formed on surfaces of the iron alloy grains, and the iron alloy grains are bonded to each other via the oxide film.

13. The coil component according to claim 12, wherein the thickness of the oxide film is 0.6 μm or less.

14. The coil component according to claim 12, wherein the oxide film has a multilayer structure that includes a first oxide film and a second oxide film formed on the outer side of the first oxide film.

15. The coil component according to claim 14, wherein the first oxide film has, as a primary component, an oxide that contains at least one of chromium and aluminum, and the second oxide film has, as a primary component, an oxide that contains iron and at least one of chromium and aluminum, and is thicker than the first oxide film.

16. The coil component according to claim 11, wherein the magnetic body part further comprises a resin covering the iron alloy grains.

17. The coil component according to claim 1, wherein at least either one of the oblate soft magnetic grains or the spherical grains is at least either one of amorphous alloy grains or ferrite grains.

18. The coil component according to claim 1, wherein the oblate soft magnetic grains and the spherical grains of the magnetic body part are constituted by soft magnetic grains covered with a resin, and the soft magnetic grains are insulated from each other by the resin.

19. The coil component according to claim 1, wherein the size of the coil component in the preset axis direction is 1 mm or less.

* * * * *